United States Patent [19]

DiMatteo et al.

[11] Patent Number: 4,813,088

[45] Date of Patent: Mar. 21, 1989

[54] PERSON TRANSFER ARRANGEMENT

[75] Inventors: Paul DiMatteo, Dix Hills; Charles F. Chubb, Brookville; Robert Segnini, Stony Brook, all of N.Y.

[73] Assignee: Nova Technologies, Inc., Hauppauge, N.Y.

[21] Appl. No.: 58,943

[22] Filed: Jun. 5, 1987

Related U.S. Application Data

[63] Continuation-in-part of Ser. No. 731,533, May 7, 1985, Pat. No. 4,776,047.

[51] Int. Cl.[4] ..... A61G 7/08

[52] U.S. Cl. ..... 5/81 R; 5/81 B; 5/83

[58] Field of Search ..... 5/60, 81 R, 81 C, 83, 5/84, 90

[56] References Cited

U.S. PATENT DOCUMENTS

| | | | |
|---|---|---|---|
| 1,635,575 | 7/1927 | Cole | 5/81 B |
| 4,016,005 | 4/1977 | DiMatteo | 5/81 R X |
| 4,504,988 | 3/1985 | Deutchman | 5/81 R |

FOREIGN PATENT DOCUMENTS

| | | | |
|---|---|---|---|
| 172296 | 2/1980 | European Pat. Off. | 5/81 R |
| 716981 | 1/1942 | Fed. Rep. of Germany | 5/60 |

*Primary Examiner*—Gary L. Smith
*Assistant Examiner*—Michael F. Trettel
*Attorney, Agent, or Firm*—Max Fogiel

[57] ABSTRACT

A transfer system including a transfer module that operates in conjunction with a compatibly equipped bed and a standard wheelchair to transport a person from a supine position on the bed to a seated position on the wheelchair.

37 Claims, 21 Drawing Sheets

PERSON TRANSFER ARRANGEMENT

BACKGROUND OF THE INVENTION

The present application is a continuation-in-part of the parent application Ser. No. 731,533 filed May 7, 1985, U.S. Pat. No. 4,776,047.

The process of transferring an invalid person from a hospital bed to a wheelchair, to a commode, or to a toilet, or assisting such a person in such a transfer, often involves more than one person, is labor-intensive and can be costly. The task frequently requires considerable strength and is occasionally a source of injury to the person, nurse, or attendant. These problems often are the major factors that cause a person to be hospitalized or moved to a nursing home, rather than being cared for at home. They also increase the cost of caring for persons in hospitals and nursing homes.

Accordingly, it is the primary object of the present invention to provide a transfer system including a transfer module in combination with a suitably equipped bed and wheelchair, whereby a person can be easily, safely, and comfortably transferred between a bed and a wheelchair with no effort on the part of the person, and requiring only minimal physical strength or skill from an attendant.

Another object of the present invention is to comfortably lift and rotate a seated person, together with the seat, leg rest and a back support, so as to move him backwards onto a bed, and to transport him fully onto the bed with a moving sheet.

It is another object of the present invention to provide means for transferring the person between a bed and a commode.

It is a further object of the present invention to provide means for the person to make use of a chamber pot in the wheelchair or use of a toilet after the wheelchair has been positioned over a toilet bowl.

It is still another object to provide modifications to standard beds and wheelchairs whereby the modified beds and wheelchairs can be employed with the transfer module for patient transfer, according to the present invention.

Additional objects and advantages of the present invention will become evident from the following description of specific embodiments when read in connection with the accompanying drawings.

BRIEF DESCRIPTION OF THE DRAWINGS

FIGS. 4*a* and 4*j* are schematic views showing two methods of supporting the sheet hem shown in FIG. 4*h;*

DESCRIPTION OF THE PREFERRED EMBODIMENTS

FIGS. 1*a* through 1*i* illustrate schematically the principles and steps used to transport a person 1 from a reclining position on bed 2 to a seated position on a wheelchair 3.

Figure 1A:
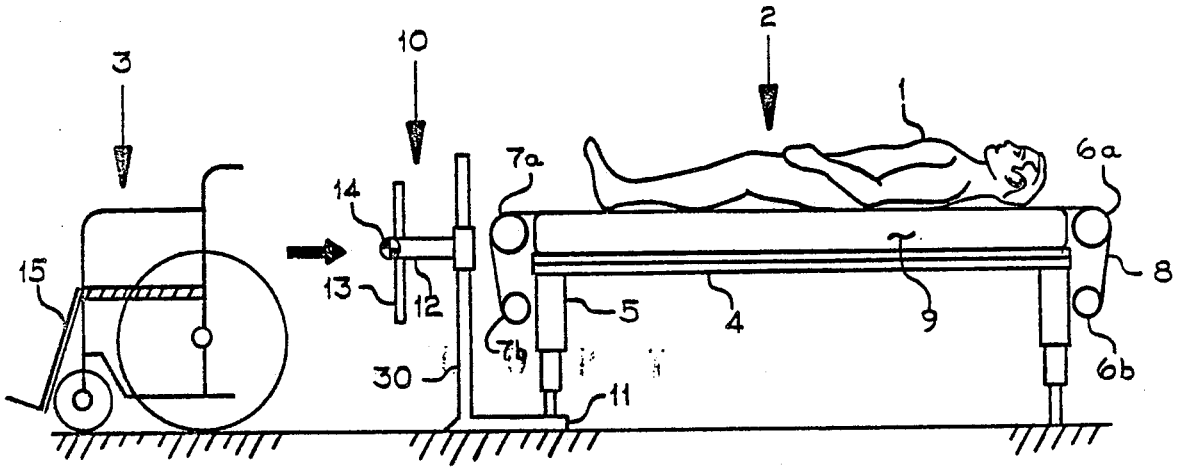
FIGS. 1*a* through 1*i* are schematic sequential views showing a patient being transferred from a bed to a wheelchair under the principles of the present invention, using a sliding leg rest.

The bed 2, as shown in FIG. 1*a*, consists of a modified conventional health care bed 4. An elevating device 5, either manual or power driven, as is found on hospital and some home health care beds, is used to raise or lower the mattress 9 to the proper height to perform the required operations. Alternately, the bed 4 may be blocked up to the proper height for the duration of the patient's use. Attached to the conventional bed 4 is an arrangement for transporting a person 1 from a position on the bed to and beyond the end of the bed. This transport arrangement contains an idler roller 6*a* and a transport roller 6*b* which are mounted to the bed frame at the head end of the bed 4. Similar idler and transport rollers, 7*a* and 7*b* are mounted at the foot end of the bed 4. A specially designed bed sheet 8, approximately equal in width to the bed and significantly longer than the bed, is fastened to and partially rolled up on the transport roller 6*b* while the other end is fastened to and partially rolled up on the transport roller 7*b* at the foot end of the bed. Mechanical power sources such as electric motors with clutches, or hand cranks, are provided for driving the two transport rollers 6*b* and 7*b* to wind up the sheet on one roller while unwinding it from the other so as to move the sheet 8 over the surface of the mattress 9 and thereby transport person 1 reclining thereon, across the surface of the mattress.

This particular arrangement of rollers is shown to help illustrate the principles applying to the present invention, but the invention is not limited to this configuration. Other arrangements for moving a sheet across a bed to transport a person over the bed can be used equally well.

In FIG. 1*a* a wheelchair 3 is shown in a position away from the bed 2 on which a person 1 is reclining. The wheelchair 3 is a conventional wheelchair which has been modified by replacing the normal foot and leg rests with a sliding leg rest 15 for use in the transfer process.

Between the bed 2 and wheelchair 3 is a transfer module 10, which includes a column 30 standing on a base 11 on the floor. The base 11 has extensions which are fastened to two of the legs of the bed 2 and hold the bed 2 in alignment with the transfer module 10. The column 30 includes a vertical drive, to be described, to raise and lower a lifted member 12. A cradle 13 is rotatable about an axis 14 on the lifted member 12 by a rotation drive, also to be described.

Figure 1B:
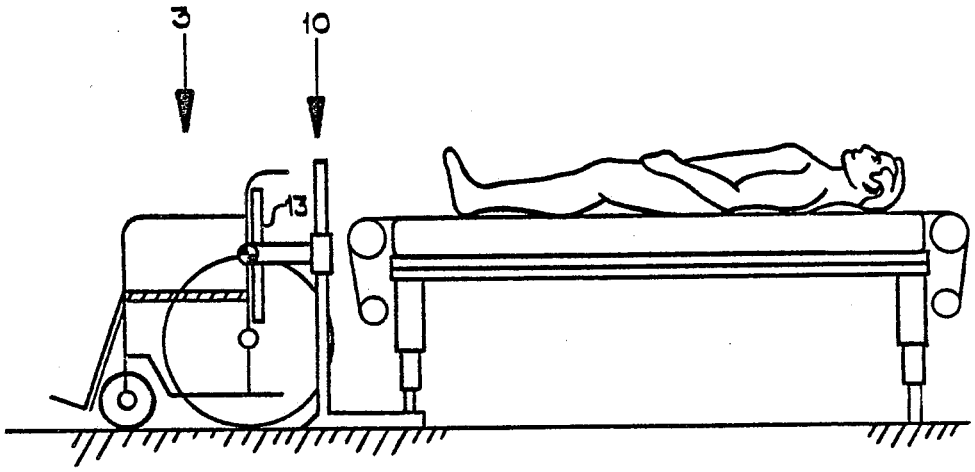

In FIG. 1*a* the transfer process is started by pushing the wheelchair 3 toward the transfer module 10. The wheelchair 3 is pushed to the transfer module 10, as shown in FIG. 1*b*, and a latching mechanism locks the wheelchair 3 securely to the cradle 13.

Figure 1C:
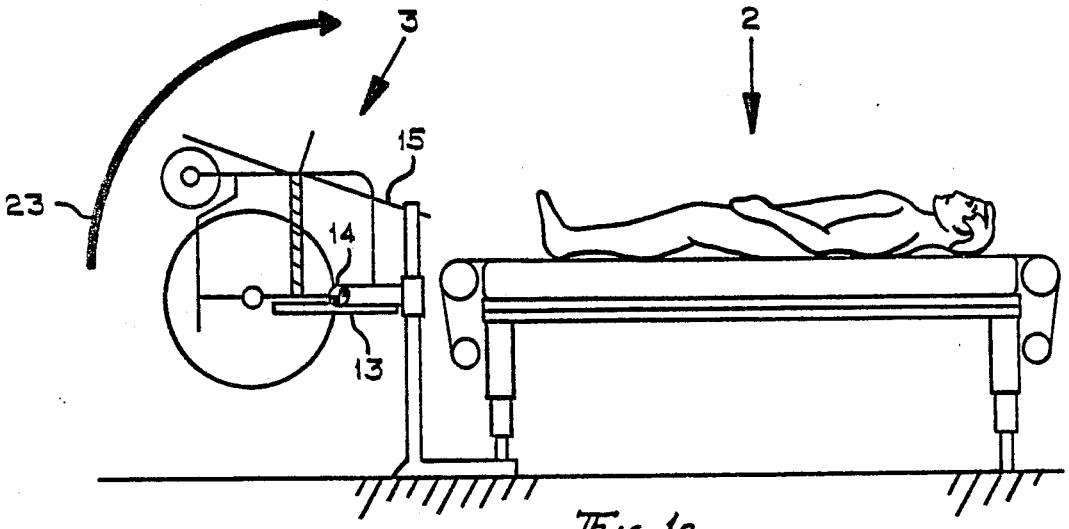

As shown in FIG. 1*c* by arrow 23, the cradle 13 and attached wheelchair 3 are rotated 90 degrees about the pivot point 14. When the wheelchair has been rotated by 90 degrees, gravity causes the leg rest 15 to slide down toward the bed 2.

Figure 1D:
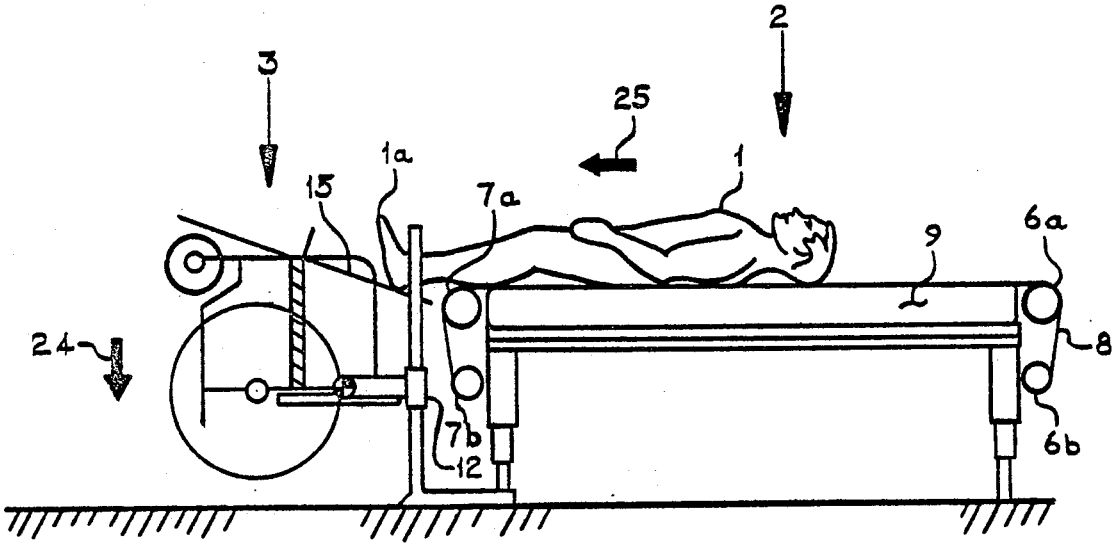

As shown in FIG. 1*d* by arrow 24, the lifted member 12 is driven down to lower the wheelchair 3 to bring the edge of the leg rest 15 below the surface of the mattress 9. The transport roller 7*b* is then caused to rotate counter-clockwise to wind up the sheet 8, which unwinds freely from the roller 6*b* and passes over rollers 6*a* and 7*a* and mattress 9, thereby carrying the patient 1 toward the foot end of the bed 2 as shown by arrow 25. The person's feet 1*a* are carried onto slide 15.

Figure 1E:
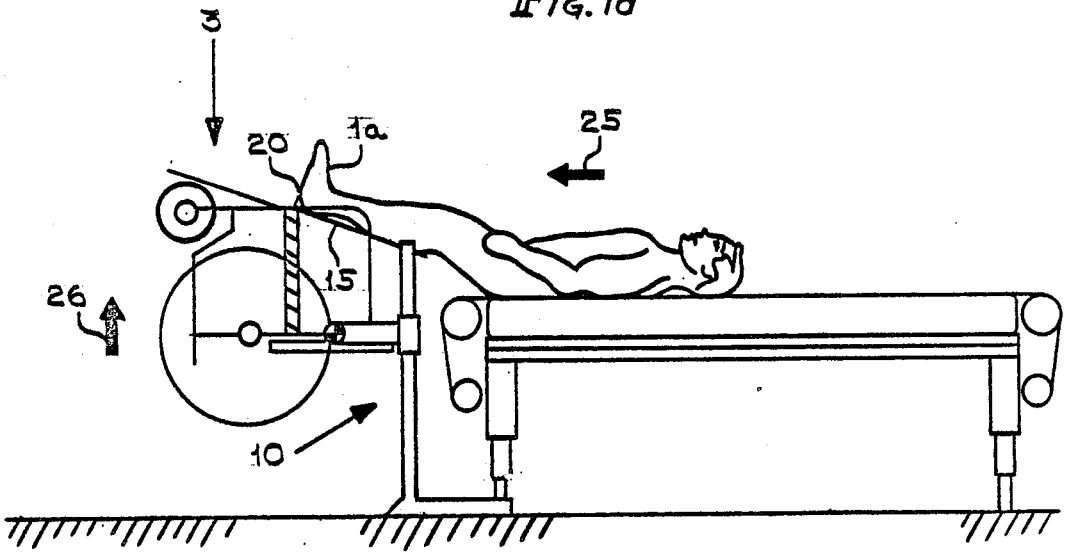

FIG. 1*e* shows the continuation of the transport action. When the person's feet 1*a* approach or reach the foot rest 20 on the leg rest 15, the vertical drive on the transfer module 10 is activated to lift the wheelchair 3, as shown by arrows 25 and 26.

Figure 1F:
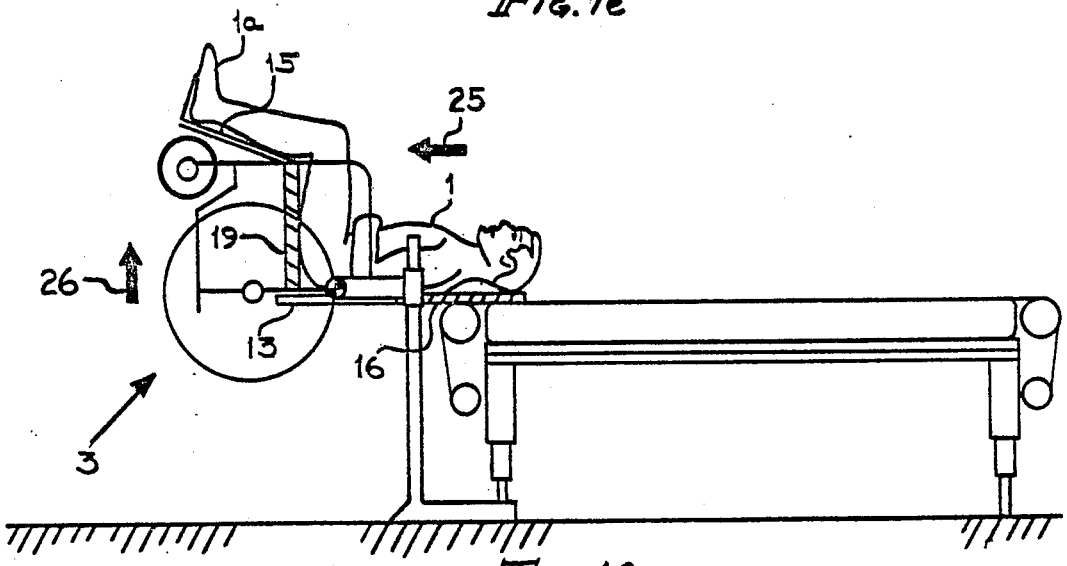

As shown in FIG. 1*f* by arrows 26 and 25, the transport and lifting actions are continued, simultaneously or alternately in increments, until the person 1 has been transported completely onto the elevated wheelchair 3, resting against the seat 19. The person's feet 1*a* push the sliding leg rest 15 into its normal position. With the vertical drive fully elevated, the cradle 13 is level with the mattress.

When the person 1 is in the wheelchair 3 in the position shown in FIG. 1*f*, a head support 16 attached to the cradle 13 is inserted underneath his head and shoulders, as described subsequently. Alternatively, the head support 16 can be inserted by an attendant and can be removably attached to the wheelchair 3.

Figure 1G:
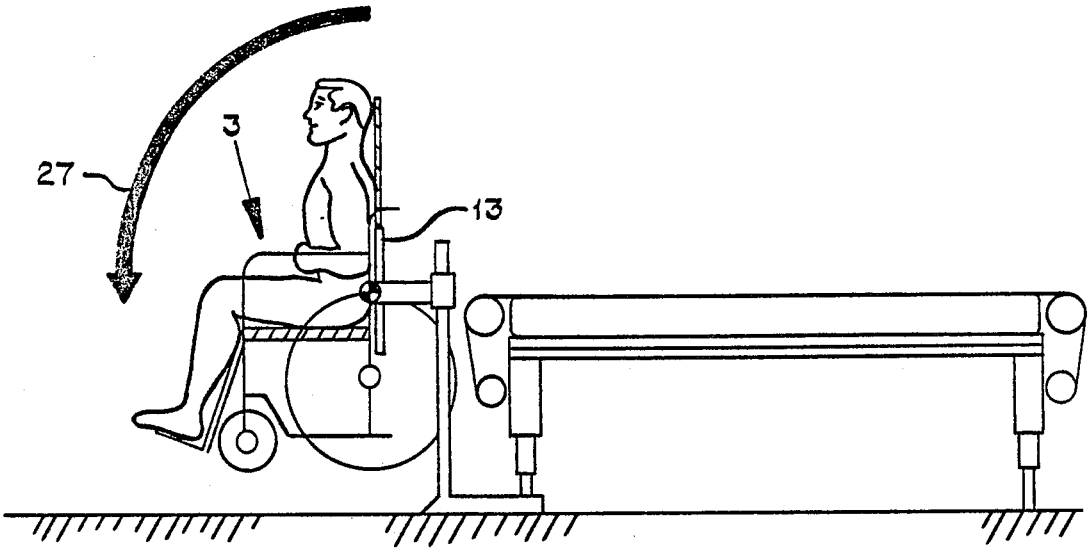
Figure 1H:
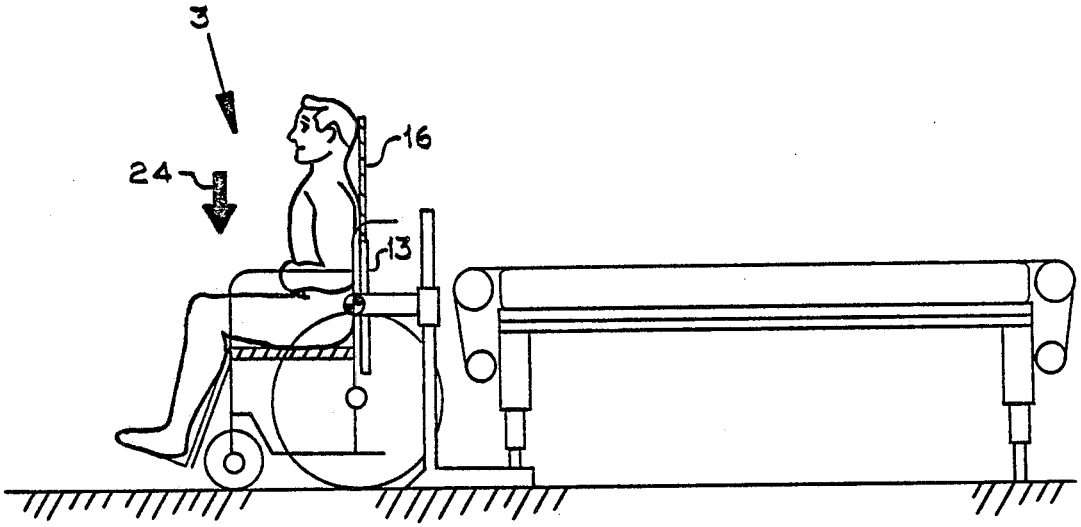
Figure 1I:
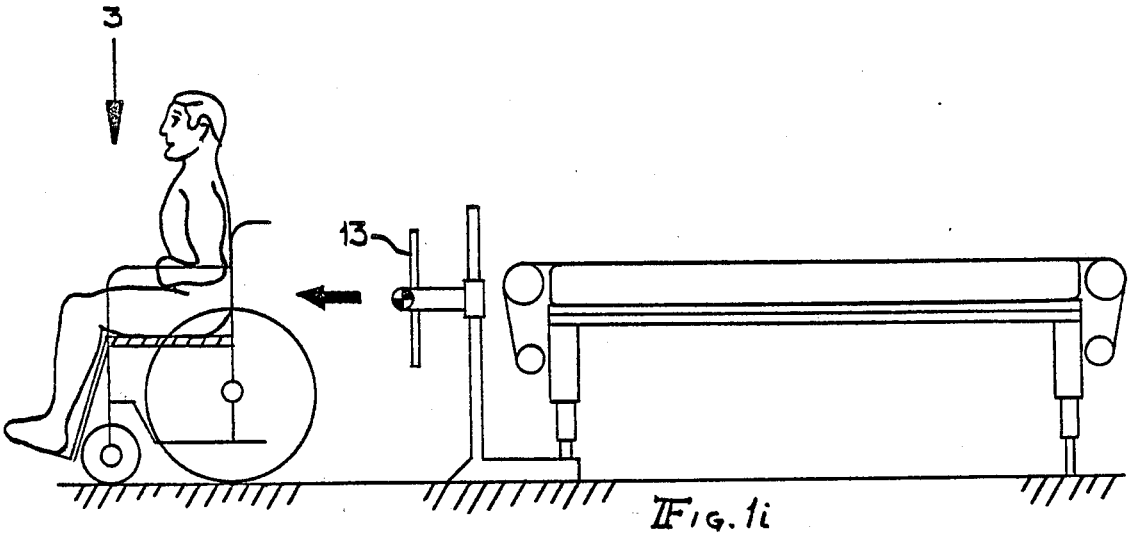

Next, the cradle 13 and the wheelchair 3 are rotated 90 degrees as shown by the arrow 27 in FIG. 1*g*, and the wheelchair is lowered to the floor as shown by the arrow 24 in FIG. 1*h*. The head support 16, shown in FIG. 1*h*, is then withdrawn and the wheelchair 3 is unlatched from the cradle 13 to complete the transfer operation, as shown in FIG. 1*i*. The person can be transferred back to the bed in a similar manner by reversing the process.

Figure 2A:
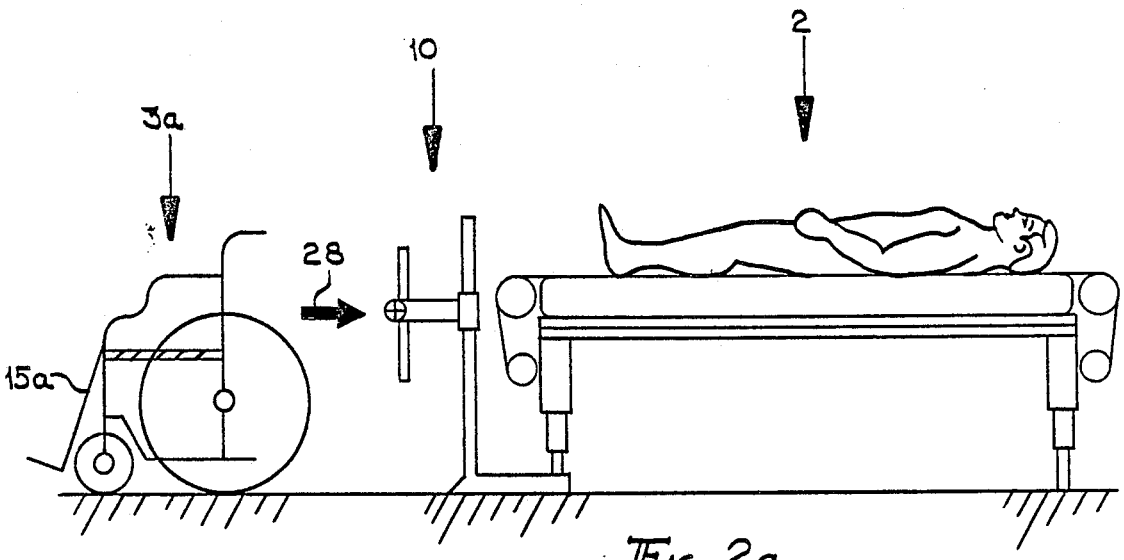
FIGS. 2*a* through 2*k* are similar schematic views showing a different arrangement with a depressible leg rest.

FIGS. 2*a*–2*k* illustrate schematically an alternate method of transporting a person 1 from a reclining position on the bed 2 to a seated position on a wheelchair 3*a*. FIG. 2*a* shows the same arrangement of the bed 2 and transport module 10 as in FIG. 1*a*. In FIG. 2*a* the wheelchair 3*a* is a conventional wheelchair which is equipped in this case, with a depressible leg rest 15*a* (rather than a sliding leg rest) to support the person's feet and legs during transfer. To start the transfer operation, the wheelchair 3*a* is pushed toward the transport module 10 as indicated by the arrow 28 in FIG. 2*a*.

Figure 2B:
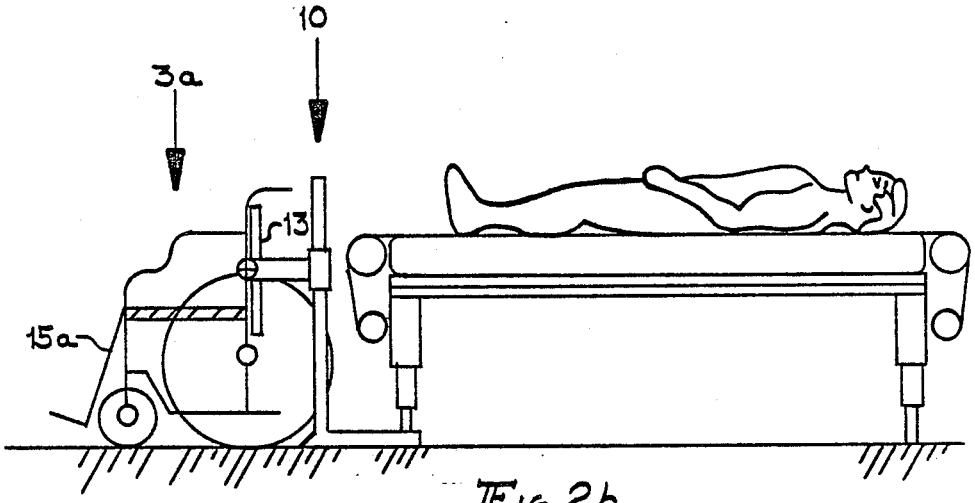

FIG. 2*b* shows the wheelchair 3*a* pushed against the transport module 10, where it is latched securely to the cradle 13. The depressible leg rest 15*a l is then unlatched, and it swings and hangs down as a pendulum.*

Figure 2C:
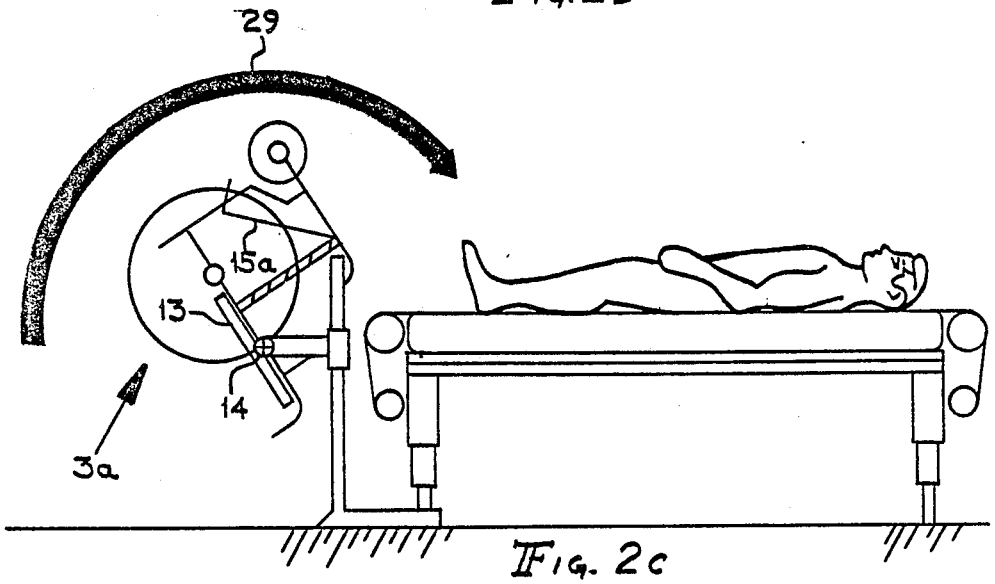

As shown by arrow 29 in FIG. 2*c*, cradle 13 and the attached wheelchair 3*a* are rotated approximately 135 degrees (rather than 90 degrees as shown in FIG. 1*c*) about pivot point 14. The depressible leg rest 15*a* swings to its fully depressed position.

Figure 2D:
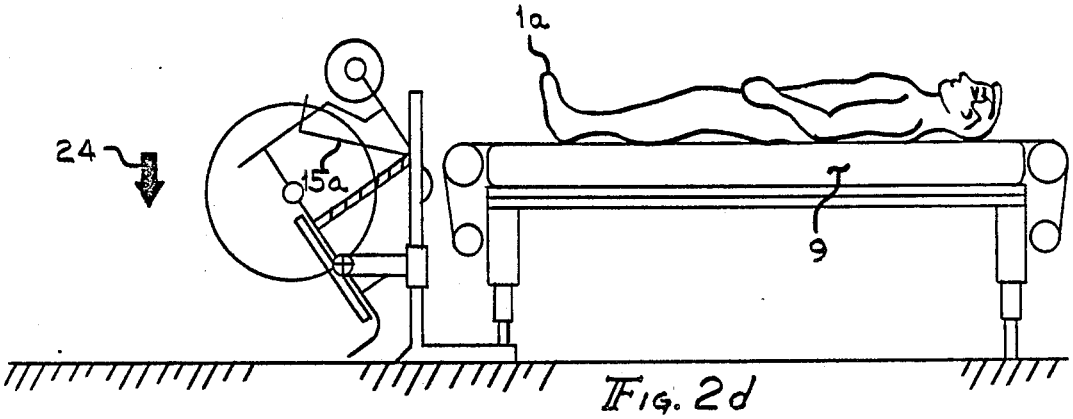

As shown in FIG. 2*d* the lifted member 12 is then lowered as shown by the arrow 24, to lower the edge of the depressible leg rest 15*a* below the top of the mattress 9, and is ready to receive the person's feet 1*a*.

Figure 2E:
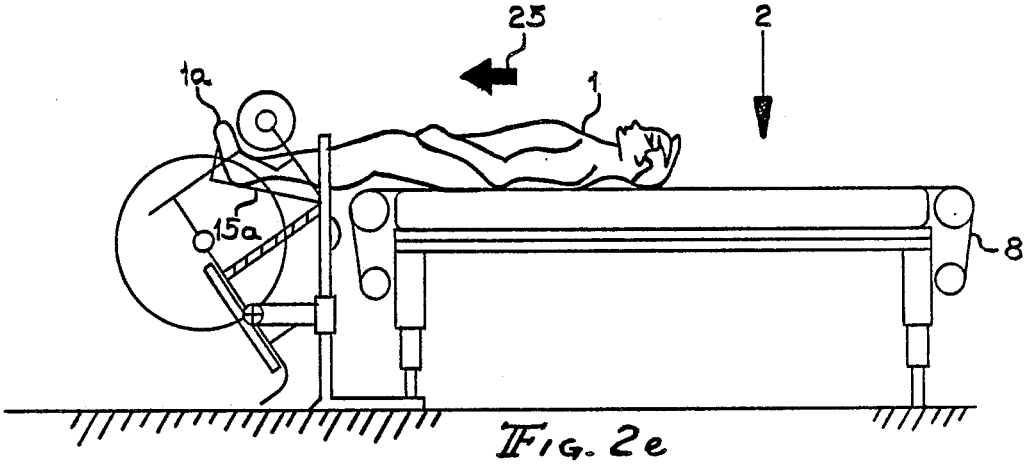

As shown in FIG. 2*e*, the transport sheet 8 is driven, as shown by arrow 25, to carry the person 1 toward the foot end of the bed 2 with his feet 1*a* moving fully onto and supported by the depressible leg rest 15*a*.

Figure 2F:
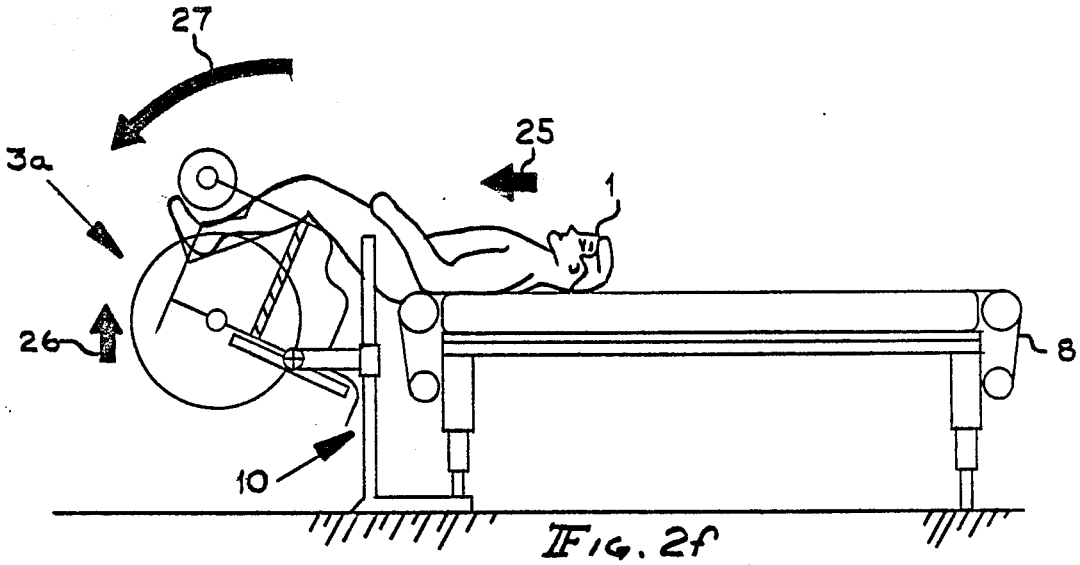
Figure 2G:
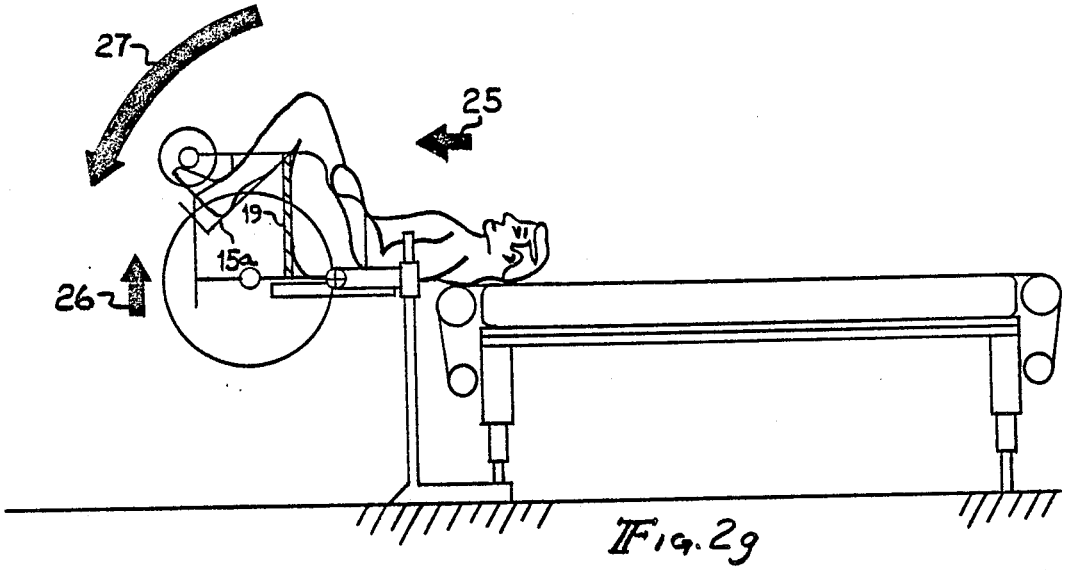

The transfer module 10 is then activated to lift and rotate the wheelchair 3*a* counter-clockwise as shown by arrows 26 and 27, respectively, in FIGS. 2*f* and 2*g* while the transport sheet 8 continues to move the person 1 onto the wheelchair 3*a* as shown by arrow 25. This process continues until the person is resting against the wheelchair seat 19 as shown in FIG. 2*g*. The transport process is facilitated by the leg rest 15*a* which supports the weight of the person's legs.

The coordinated lifting, rotating and transport sheet motions shown in FIGS. 2*f* and 2*g* may be accomplished by automatic continuous control of the lift, rotation and transport drives, or by sequential automatic or manual control of these drives, or by a combination of sequential and continuous operations.

Figure 2H:
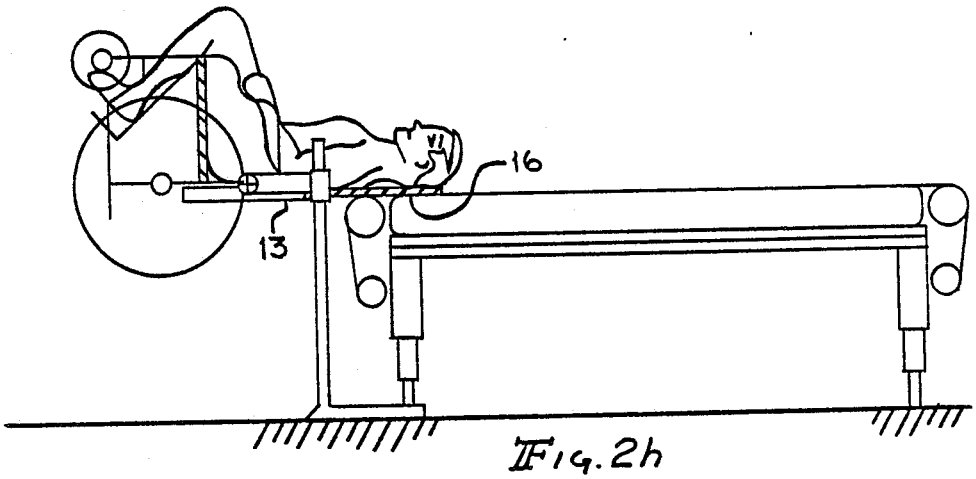

FIG. 2*h* shows that after the person is positioned against the wheelchair seat, a head support 16, attached to the cradle 13, is inserted underneath the person's head and shoulders.

Figure 2I:
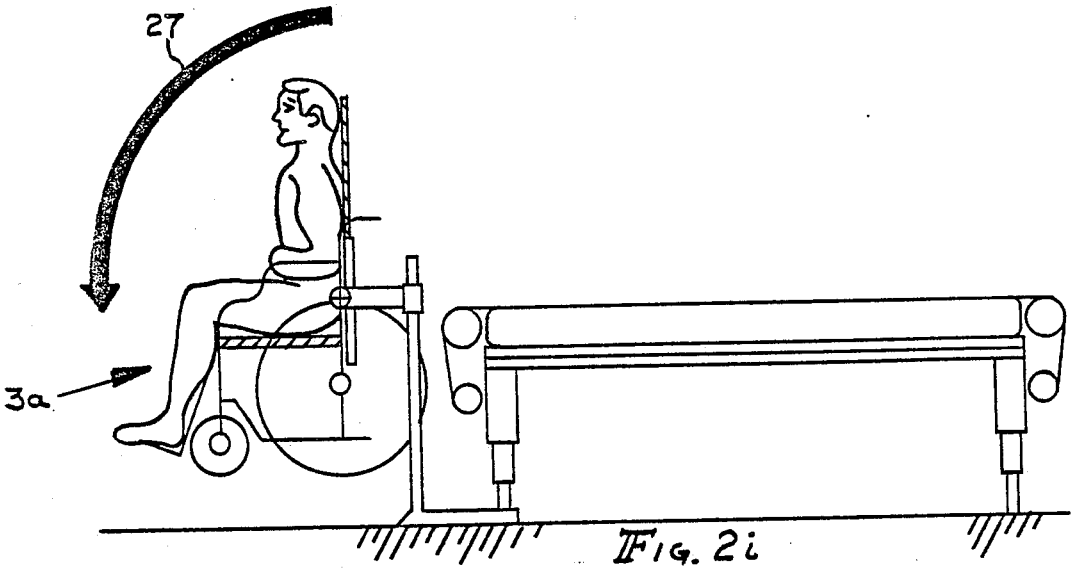
Figure 2J:
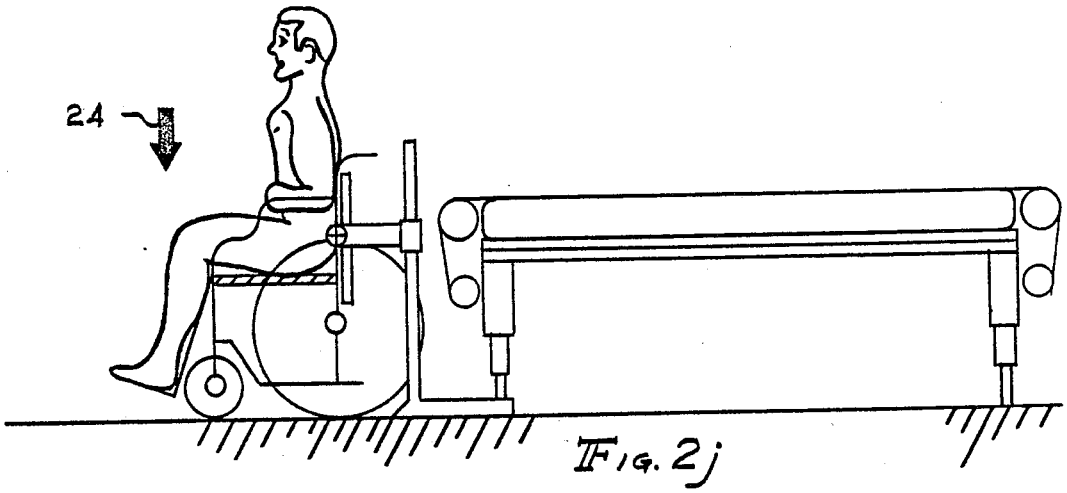
Figure 2K:
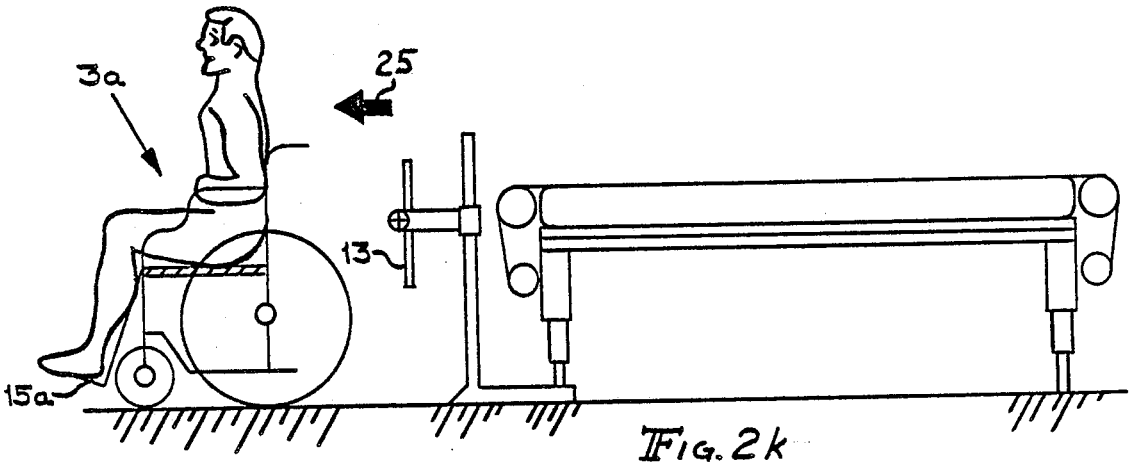

FIGS. 2*i* and 2*j* show the wheelchair 3*a* being rotated and lowered to the floor, as shown by arrows 27 and 24, respectively. To complete the transfer operation the depressible leg rest 15*a* is moved forward and latched, the head support is withdrawn, and the wheelchair 3*a* is unlatched from the cradle 13 and moved away, as shown by arrow 25 in FIG. 2*k*.

Figure 3:
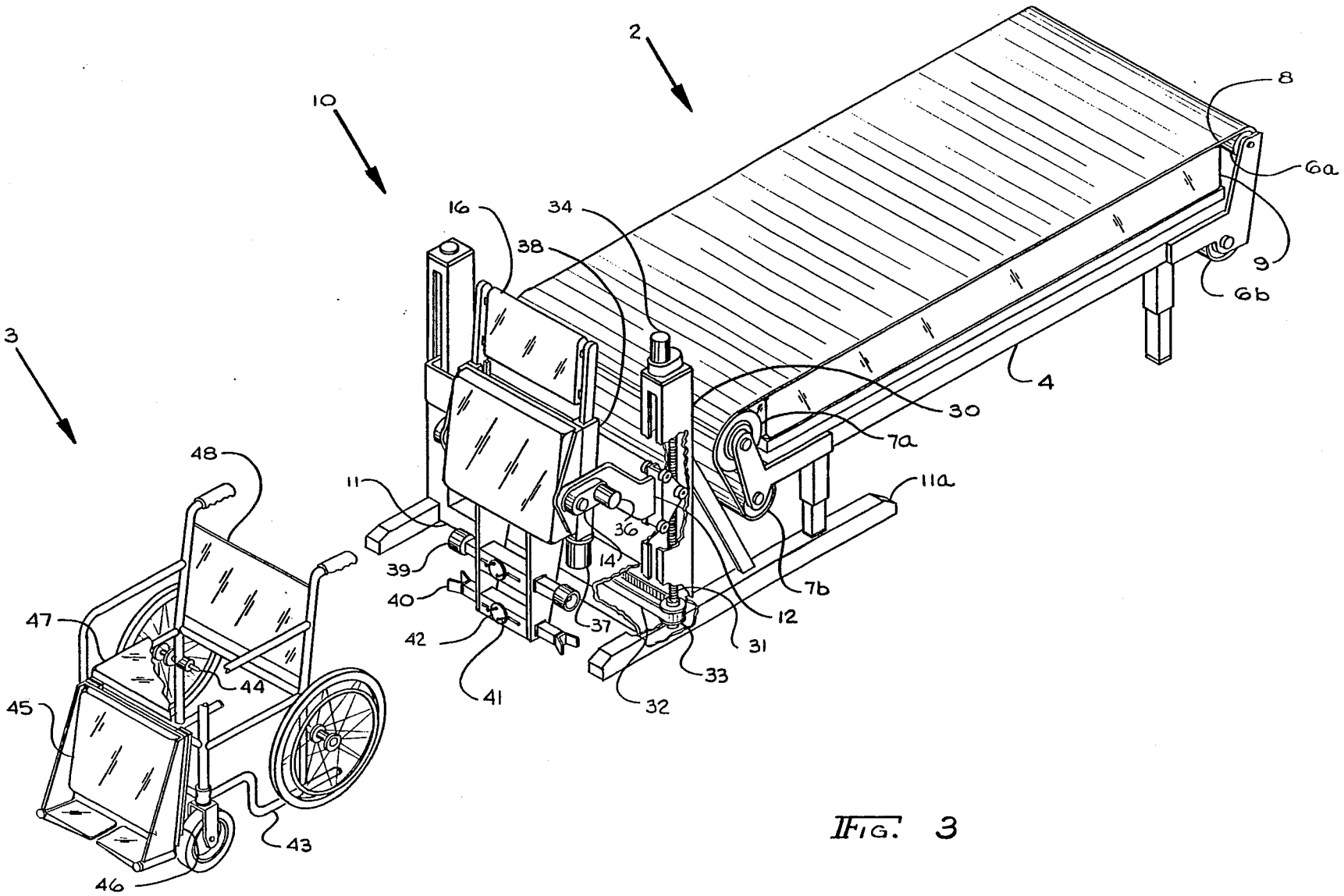
FIG. 3 is a perspective view of the equipment.

FIG. 3 is a perspective view of the equipment arrangement of FIG. 1*a*, showing the transfer module 10 attached to the bed 2 and including a wheelchair 3. The bed 2 consists of a standard hospital type bed 4 equipped with a transport sheet 8, which is partially rolled up on transport rollers 6*b* and 7*b* and passes over idler rollers 6*a* and 7*a* at each end of a mattress 9, as described previously. Transport rollers 6*b* and 7*b* are coupled to electric motors with clutches, by which the transport sheet 8 can be driven in either direction across the mattress 9.

The transport module 10 has a base 11 which includes a column 30 and a base extension 11*a* on each side. The legs 18*a* at the foot end of the bed are attached to the base extensions to hold the bed 2 fixed to the transfer module 10.

Mounted in each column 30 is a vertical drive screw 31 which passes through a nut attached to lifted member 12. The vertical drive screws 31 in the two columns are connected by the vertical drive chain 32 through sprockets 33 and are driven by a vertical drive motor 34 mounted on one of the columns. The vertical drive motor is reversible for raising or lowering the lifted member 12. Rollers 35, movable inside the column, support the lifted member against weight and torque loads.

Figure 3A:
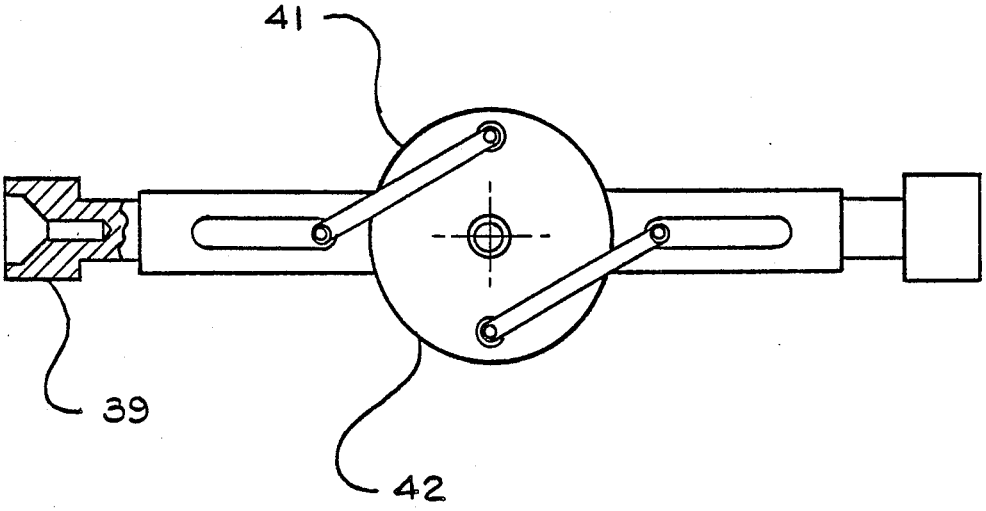
FIG. 3*a* is a partial front view of the apparatus showing a lock mechanism.

The cradle 13 is reversibly rotatable about pivots 14 by the cradle drive motor 36 on the lift member 12. The head support member 16 is mounted in slides 38 on the cradle and is driven by a head support motor 37 for extending the head support member above the cradle 13, as shown, or for retracting the head support member behind the cradle, as indicated in FIGS. 1*g* and 1*h*. Alternatively, a head support can be manually attached and removed by an attendant. Wheelchair axle clamps and frame clamps 39 and 40 are slidably mounted at the bottom of the cradle 13. With the wheelchair 3 positioned against the cradle, the clamps 39 and 40 are movable against both sides of the wheelchair frame 43 and axles 44 by means of a clamp drive motor mounted on the back of said cradle but not visible in FIG. 3. The clamp drive motor is geared to the drive discs 42. As shown in FIGS. 3 and 3*a*, a drive disc 42 is connected by links 41 to the clamps 40 or 39 so that rotation of the clamp drive motor moves the clamps to secure wheelchair 3 to the cradle for lifting.

The wheelchair 3 is of conventional design except for the leg rest 45, which is mounted on a slide 46 to enable the leg rest to move over the wheelchair seat 47 and back rest 48, as shown in FIG. 1*d*. Alternatively, a depressible leg rest may be used, as shown in FIG. 2*c*.

FIGS. 4*a* through 4*g* show schematically an alternate arrangement for transferring a person between a wheelchair and a bed.

Figure 4A:
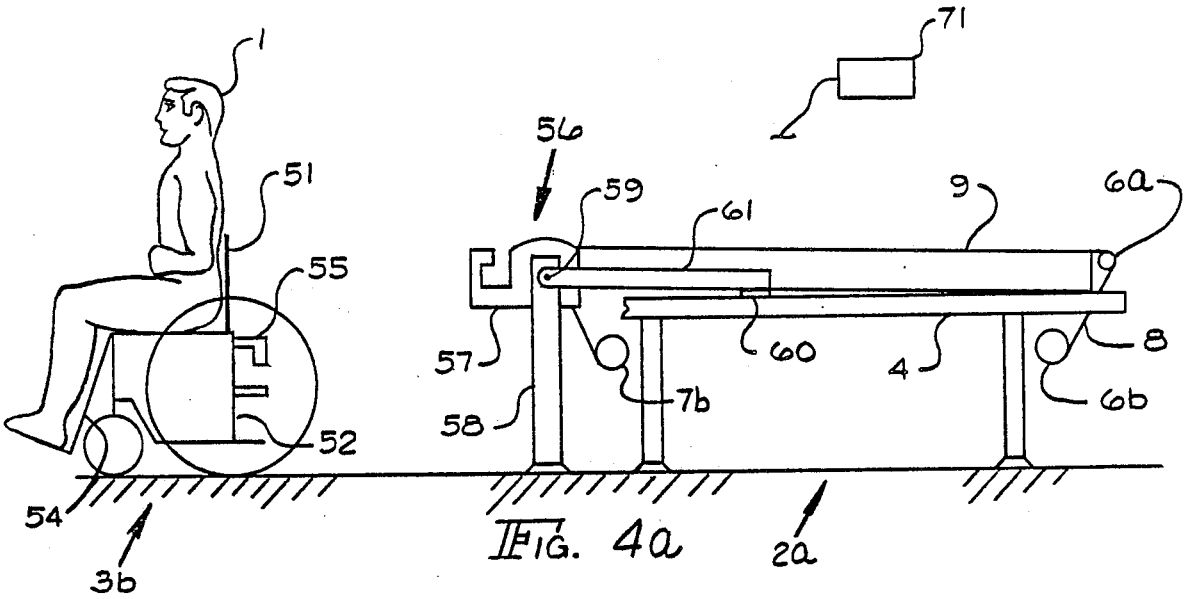
FIG. 4*a* through 4*g* are schematic sequential views showing a patient being transferred from a wheelchair to a bed, using an arrangement in which the mattress is lifted.

FIG. 4*a* shows a side view of a person 1 seated in a wheelchair 3*b*, which has a movable back rest 51, a leg rest 54 and lift bracket 55 attached to the frame 52. A bed 2*a* comprises a modified conventional health care bed 4 which is equipped with a transport sheet 8. The transport sheet extends over the mattress 9, and over an idler roller 6*a*, to transport rollers 7*b* and 6*b*, on which the sheet is partially wound, at opposite ends of the bed. Motors are coupled through clutches to the rollers 7*b* and 6*b* for moving the transport sheet. Attached to the bed 4 at its foot end, is a lifting device 56 comprising a lift bar 57, which extends parallel to the end of the mattress and lift columns 58 at each side of the bed. The lift bar 57 is rotatably supported at each end by bearings on the lift columns. As shown and described subsequently, these bearings can be lowered or raised by a vertical drive motor coupled to vertical drive screws in the vertical columns, and the lift bar is rotatable by a rotation lift motor to which it is coupled. Mattress lift arms 61 on each side of the bed 4 are pivotally supported by axles 59 in bearings on the lift columns 58 and are attached to the ends of a support member 60 which extends under the mattress 9. In FIG. 4*a* the lift bar 57 is shown in its uppermost position; in this position the lift bar rotation axis is aligned with the mattress lift arm axle 59, and the lift bar is coupled at each end to the lift arm axles, through mated couplings to be described, so that rotation of the lift bar rotates the lift arm.

A control unit 71 for regulating the transfer operations is described subsequently.

Figure 4B:
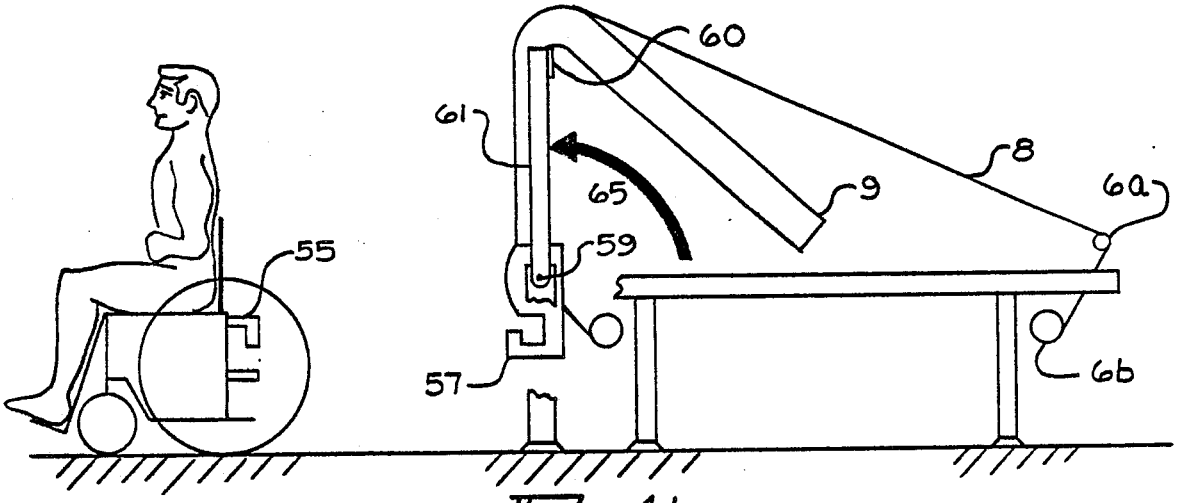

FIG. 4*b* shows the initial transfer step in which the rotation drive motor rotates the lift bar 57 and thereby the mated couplings and the mattress lift arms 61 about the axle 59. The mattress 9 is thereby lifted in the direction of arrow 65 by cross member 60. The transport sheet 8, supported by the idler roller 6*a*, is partially drawn off the roller 6*b* by the motion of the mattress 9. The lift bar 57 is now in position to engage the lift bracket 55 on the wheelchair.

Figure 4C:
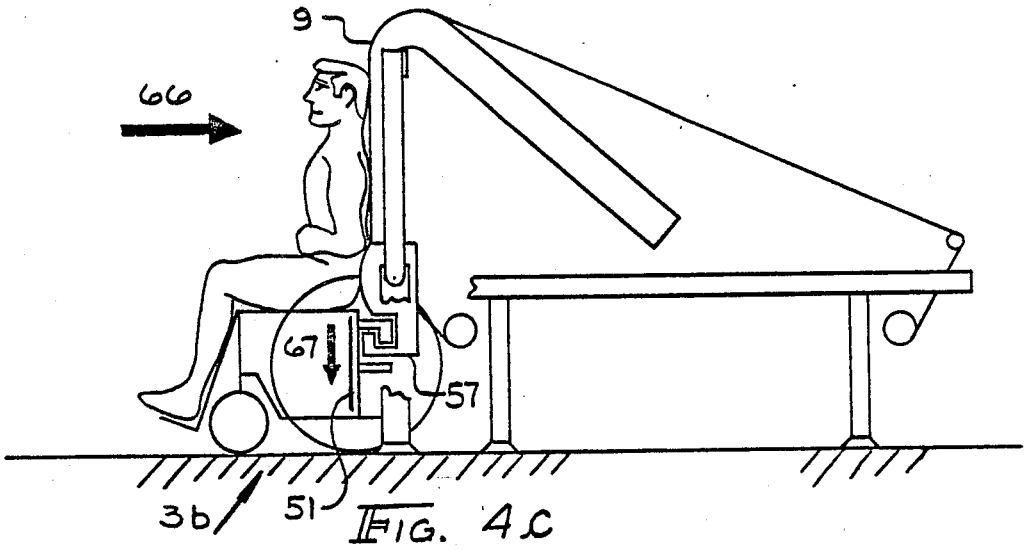

In FIG. 4*c*, the wheelchair 3*b* is moved in the direction of arrow 66 to engage the lift bracket with the lift bar 57. A safety latch, not shown, secures the wheelchair to the lift bar, and the movable back rest 51 is moved down on slides in the direction of arrow 67 to below the seat, by manual means, such as a hand crank, or by motor means. Alternatively, the back rest may be lifted off the wheelchair or removed in some other way from behind the person's back. After the back rest is removed, the person rests against and is supported by the mattress 9.

Figure 4D:
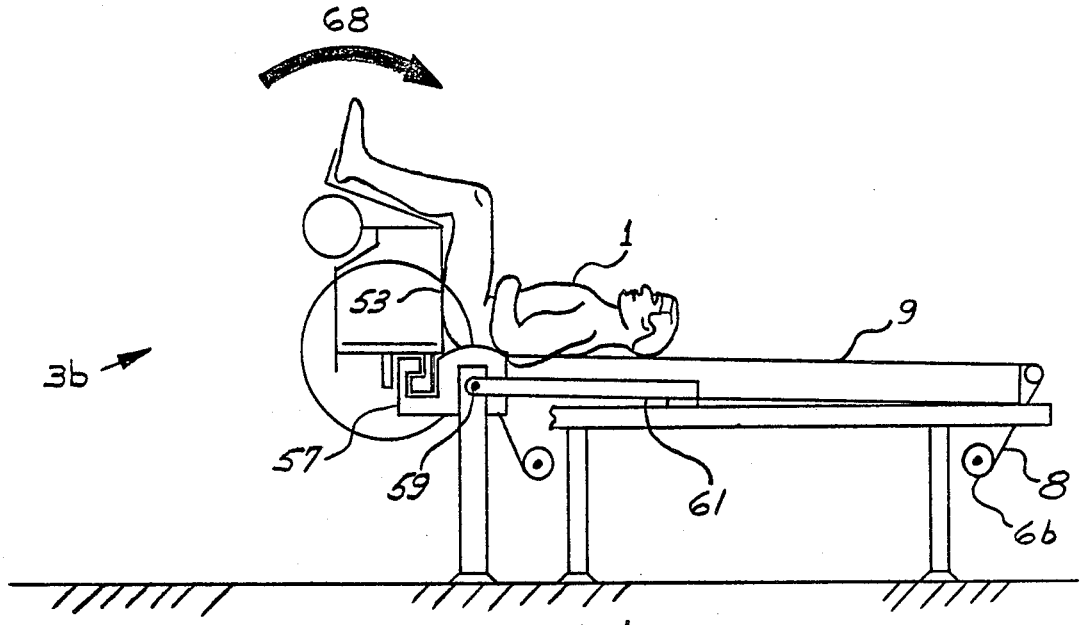

In FIG. 4*d*, the rotation lift drive motor rotates the lift bar 57 through 90 degrees clockwise about axis 59, thereby rotating the wheelchair 3*b*, the mattress lift arms 61, and the person 1 supported by the mattress 9, in the direction of arrow 68. The person now rests against the seat 53 with his back supported on the mattress 9. As the mattress 9 is lowered, the roller 6*b* is driven to take up slack in the sheet 8.

Figure 4E:
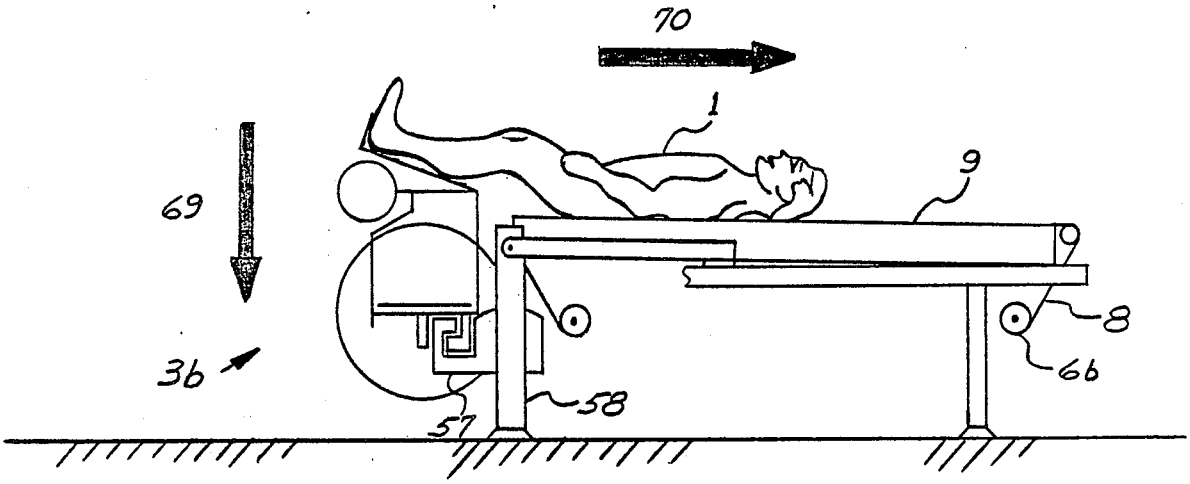
Figure 5:
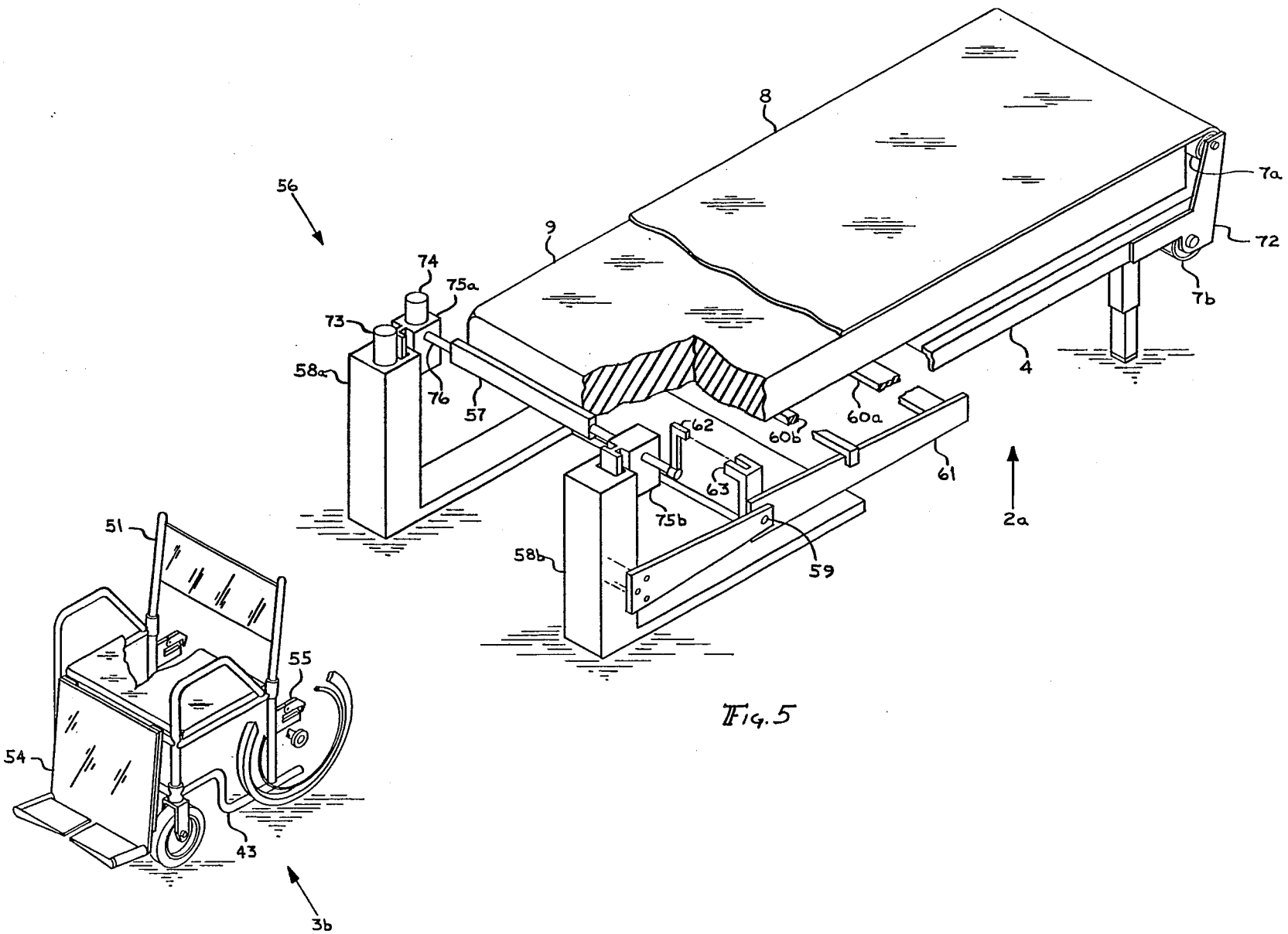
FIG. 5 is a perspective view of the apparatus in FIG. 4*a;*

In FIG. 4*e*, the vertical drive motor acting through the vertical drive screws in lift columns 58 lowers the lift bar 57 and the wheelchair 3*b* in the direction of arrow 69. Simultaneously, the roller 6*b* is driven to wind up the sheet 8, thereby carrying the person 1 onto the mattress 9, as shown by arrow 70. Lowering the lift bar disengages the mated couplings to the lift arms, as shown in FIG. 5 and described subsequently.

Figure 4F:
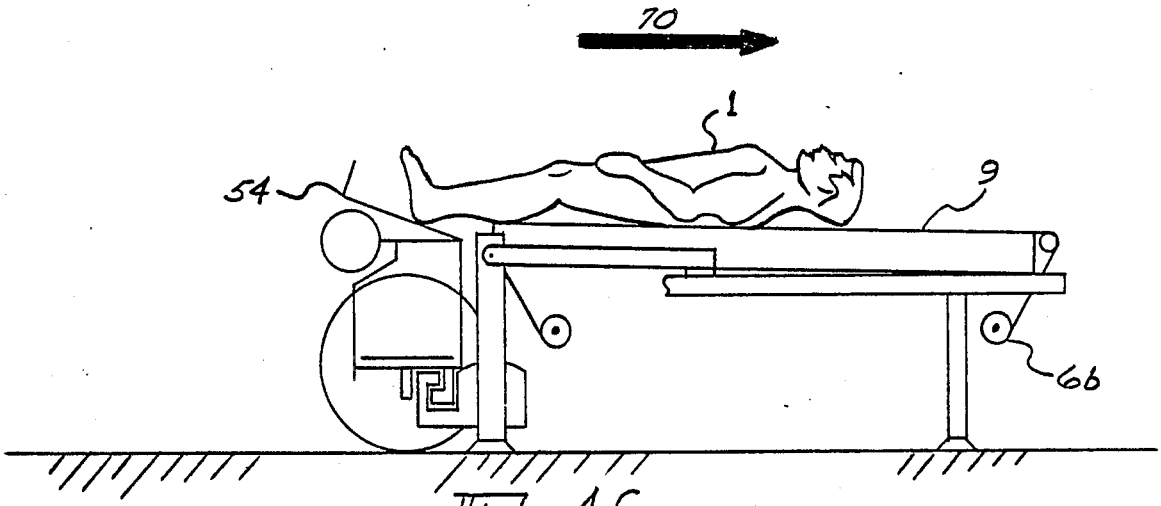

FIG. 4*f* shows the wheelchair fully lowered. The roller 6*b* continues to move the person 1 toward the middle of the mattress 9 in the direction of arrow 70, as the person's feet slide off the leg rest 54.

Figure 4G:
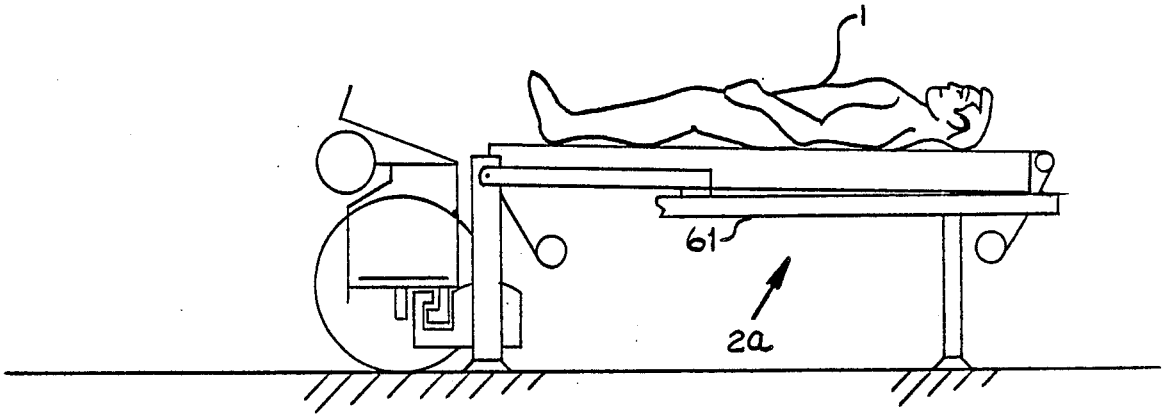

FIG. 4*g* shows the person 1 transported to the center of the bed 2*a*. The wheelchair can remain in this lowered position, ready for the person to be transferred from the bed. Alternatively, the wheelchair can be removed by raising it with the vertical drive motor, and simultaneously rotating it counter-clockwise with the rotation lift motor. As shown subsequently, the mattress lift arms 61 are not moved, since the couplings to them engage only when the lift bar is rotated clockwise and fully lifted. After the wheelchair has been rotated and lowered it can be released and removed.

Transfer of the person 1 back to the wheelchair is accomplished by reversing the process. If the wheelchair is apart from the bed, it is latched to the lift bar, which is then partially rotated clockwise to raise the wheelchair off the floor, as described previously. The vertical drive is then activated to lower the wheelchair as it continues to be rotated, until the position shown in FIG. 4*g* is reached. The transport sheet drive is then activated to move the person toward and onto the wheelchair, his feet sliding onto the leg rest.

When the person's feet reach the foot rest 54, as shown in FIG. 4*f*, the vertical lift drive is activated to raise the wheelchair to its highest position, shown in FIG. 4*d*. The transport sheet motion continues until the person is moved against the wheelchair seat 53 as shown in FIG. 4*d*. The rotation drive then rotates the wheelchair back to the floor and raises the mattress 9 as shown in FIG. 4*c*. The back rest 51 is then replaced behind the person and the wheelchair is released and moved away.

Figure 4H:
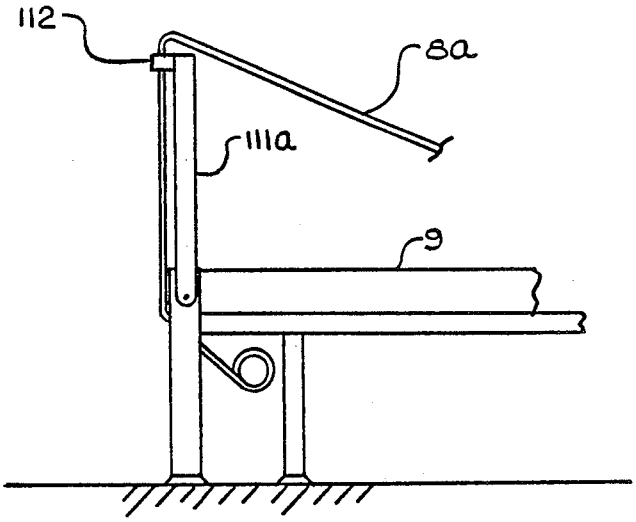
FIG. 4*h* is a schematic side view showing an arrangement in which the sheet, instead of the mattress, is lifted.

FIG. 4*h* shows schematically an alternate arrangement in which lift arms 111*a* raise the transport sheet rather than the mattress 9, to support the person's back. The transport sheet has a thickened hem 8*a* which slides through and is captured in shaped grooves in hem lifting members 112 attached to the ends of lift arms 111*a*. The sheet is thereby supported for being lifted.

Figure 4I:
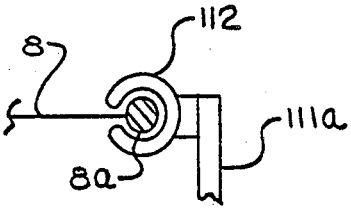

FIG. 4*i* shows schematically the sheet 8 with the thickened hem 8*a* slidably held by the hem lifting member 112 on lift arm 111*a*.

Figure 4J:
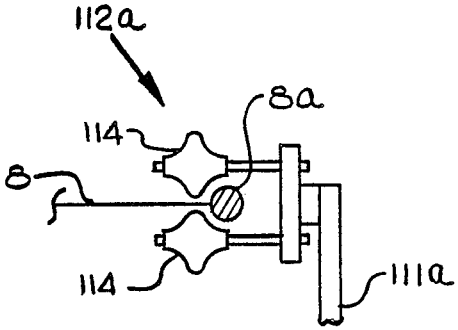

FIG. 4*j* shows another type of hem lifting member 112*a*, in which the thickened hem 8*a* of sheet 8 is supported by shaped rollers 114, which are rotatably mounted to the frame 111*a*.

Figure 4K:
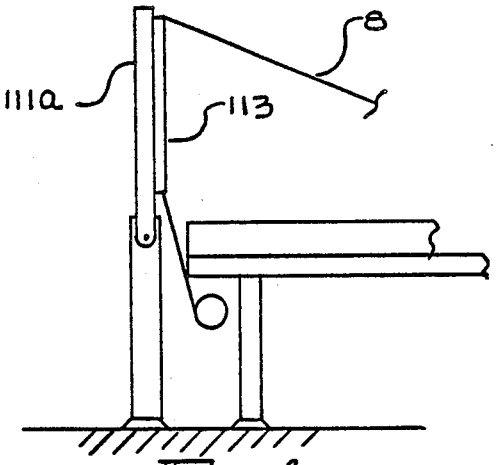
FIG. 4*k* is a schematic side view showing a different arrangement for lifting the sheet.

FIG. 4*k* shows schematically another arrangement wherein the sheet 8 is supported by a flexible sheet support member 113, extending under the sheet and attached to the lift arms 111*a*. The sheet support member 113 is usable with, or instead of, hem lifting members 112 for lifting the sheet.

FIG. 4*a* shows a control unit 71 which connects to and is used to regulate the operation of transport sheet drive motors and clutches as well as the vertical and rotation drive motors in the lifter. Limit switches in the lifter and sensors for measuring position of a person and slack or tension in the transport sheet also are connected to the control unit, which contains control switches, timing and sequencing controls, and logic circuitry, well known in the art to provide either manually-controlled or manually-initiated and automatically-controlled transfer operation.

Figure 4M:
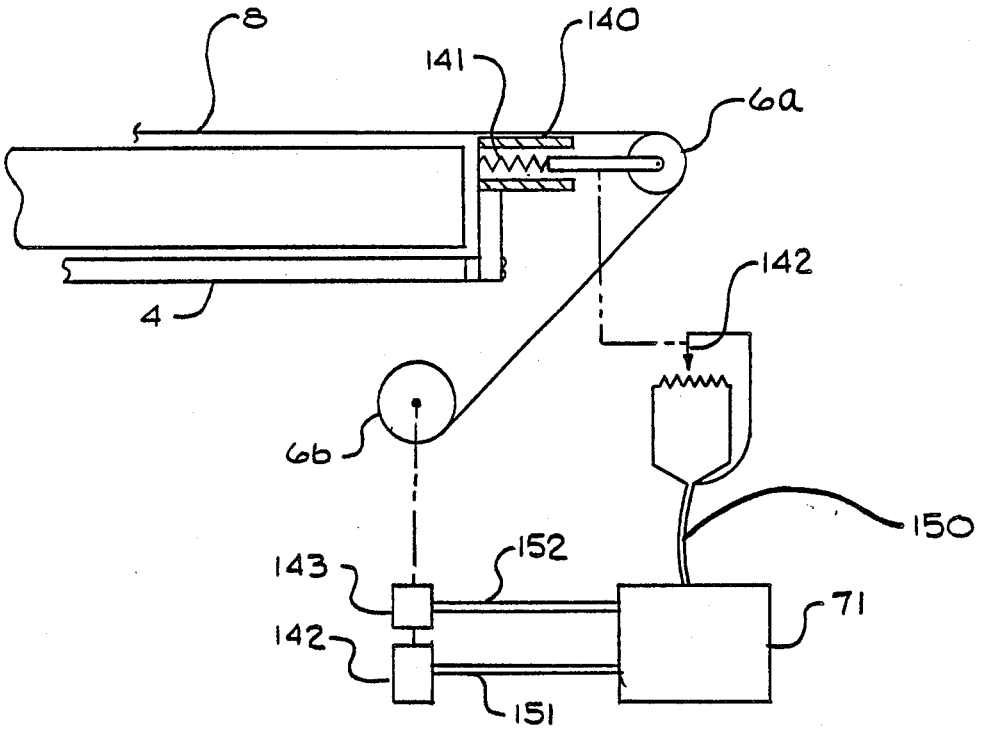
FIG. 4*m* is a partial schematic view of the bed showing an arrangement for measuring slack in the sheet for controlling the sheet drive motor.

FIG. 4*m* shows schematically a sheet sensor to measure slack or tension in the transport sheet for controlling a sheet drive motor and clutch. The sheet sensor comprises the idler roller 6*a* which is mounted to a slide 140 extending from the bed 4. A compression spring 141 pushes out the roller 6*a* to take up slack in the transport sheet 8, and the extension of the roller is measured by a transducer 142. Transducer 142 is depicted as a potentiometer, but it may be another type of position sensing device, or it may comprise switches which are arranged to close at pre-determined extensions of the roller. If the extension range of the roller is large, the transducer effectively measures the slack in the transport sheet 8 taken up by motion of the roller 6*a*. If the extension range is small, the transducer effectively measures tension in the transport sheet. In either case, the transducer is connected through a cable 150 to threshold and logic circuitry in the control unit 71 for controlling the motor 142 and clutch 143, which are coupled to the transport roller 6*b*. Cables 151 and 152 connect the motor and clutch, respectively, to the control unit.

When the transport sheet 8 is loosened by lowering a previously raised head section of a hospital type bed or by lowering the mattress lift arms, and when the roller extension exceeds a predetermined value, the motor 142 is actuated to wind up the transport sheet until the roller extension drops below a predetermined value. At that time the motor is stopped. Similarly, when the transport sheet 8 is tightened by raising the head section of the bed or the mattress lift arms, and when the roller extension drops below a predetermined value, the motor 142 is actuated, or clutch 143 is disengaged for unwinding the transport sheet from the transport roller 6*b*.

Alternatively, the transducer arrangement shown in FIG. 4*m* can be replaced by a strain gauge on a fixed bracket supporting the roller 6*b* or on another component which is stressed by sheet tension.

Figure 4N:
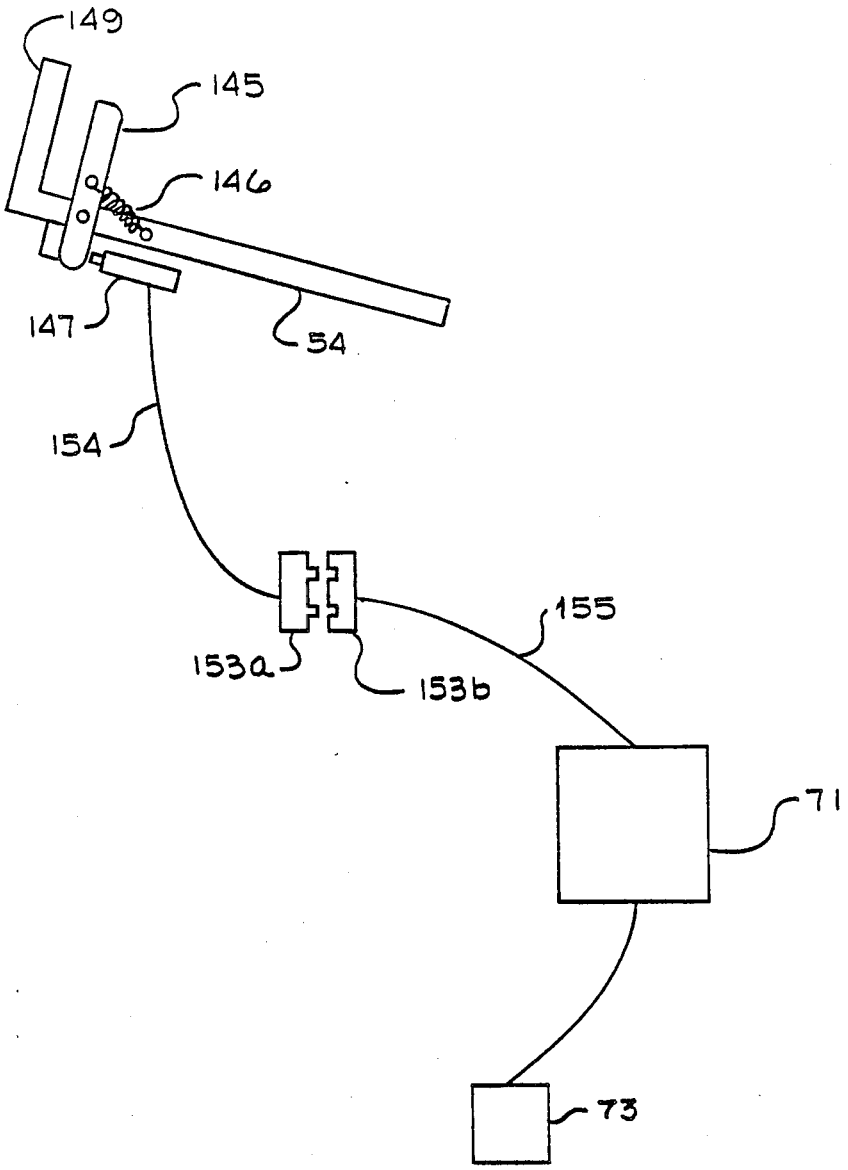
FIG. 4*n* is a schematic view of the leg rest showing an arrangement for sensing the foot position and controlling a lift motor.

FIG. 4*n* shows schematically a foot-actuated switch for controlling the vertical drive motor 73, shown in FIG. 5. When a person is transferred from the bed to a wheelchair, and when the person's foot is moved on the leg rest 54 and approaches the foot rest 149, as shown in FIG. 4*f*, the foot deflects pivoted foot plate 145 against the spring 146, so as to close a switch 147. Switch 147 is connected to logic circuitry in the control unit 71 through cable 154, contacts 153*a* on the lift bracket 55 engaged with contacts 153*b* on the lift bar, and cable 155. The logic circuitry responds to the switch closure by actuating the vertical drive motor 73 to lift the wheelchair or by stopping the sheet drive motor from transporting the person farther onto the leg rest. Alternatively, many other transmission methods can be used in place of electrical conductors between the switch 147 and the control unit. Suitable methods include radio, ultrasonic, optical, capacitive or inductive coupling.

FIG. 5 is a partial perspective view of the equipment arrangement shown schematically in FIGS. 4*a* through 4*g*. The wheelchair 3*b* has a leg rest 54, lift brackets 55 attached to a frame 43, and a back rest 51, which is removable by unlatching and lifting. Alternatively, the back rest may slide down below the seat. The bed 2*a* includes a transport sheet 8 extending across the mattress 9 on conventional bed 4 to which is fastened bracket 72 for supporting sheet drive roller 7*b* and idler roller 7*a*. A similar sheet drive roller 6*b* is mounted at the foot end of the bed 4, but is not shown in more detail for purposes of clarity. A lift unit 56 is fastened to the bed 4 at the foot end. Two lift columns 58*a* and 58*b* support lifted members 75*a* and 75*b*.

The lifted members are raised by captured nuts on vertical drive screws in the lift columns. The vertical drive screws are coupled to vertical drive motor 73 by chains and sprockets as in FIG. 3. The ends of the lift bar 57 comprise shaft 76 which is rotatably mounted in bearings in the lifted members 75*a* and 75*b* and coupled to and rotatable by rotation drive motor 74. The lift bar shaft 76 extends through the lifted members and is attached to drive members 62, which engage slotted members 63 on mattress lift arms 61 at each side of the bed. For clarity, the lift arms, slotted member, and drive member are shown on one side of the bed only. The mattress lift arms have axles 59 supported in bearings which are mounted to lift columns 58*b*. For lifting the mattress, the mattress lift arms are attached to support members 60*a* and 60*b* which extend under the mattress 9. With the lift bar 57 in its raised position as shown in FIG. 5, the drive members 62 engage the slotted members 63 forming a mated coupling, so that rotation of lift bar 57 causes rotation of the lift arms 61. When the lift bar 57 is lowered, the drive members 62 are disengaged from the slotted members 63 so that the lift bar 57 is rotatably free from the mattress lift arms.

Figure 6:
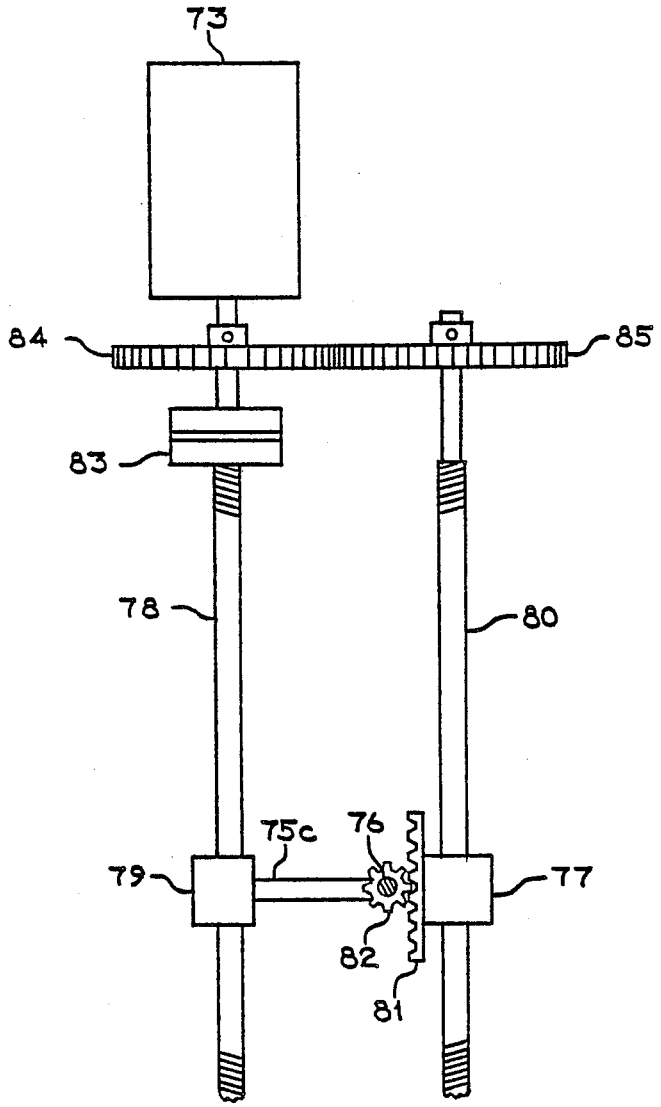
FIG. 6 is a schematic view showing a different method of rotating and lifting the wheelchair.

FIG. 6 is a partial schematic side view showing a cross-sectional view of the lift bar shaft 76 and an alternate drive arrangement in which the vertical drive motor 73 is used to both elevate and rotate the lift bar shaft 76. The vertical drive motor 73 is connected to the vertical drive screws through gears 84 and 85 and a clutch 83. A lifted member 75*c* is connected to a nut block 79 on one of the lift screws 78 whereby it is raised and lowered by the motor 73. The lift bar shaft 76 is rotatably supported by a bearing in lifted member 75*c*. A bar rotation screw 80 is coupled to the motor 73 through gears 84 and 85. A nut block 77 on the screw 80 is attached to a rack 81 which is meshed to a pinion 82 on the lift bar shaft. With the clutch 83 engaged, rotation of the vertical drive motor raises or lowers together the nut block 79, the lifted element 75*c*, the lift bar shaft 76, the nut block 77, and the rack 81. In this case there is no relative motion between the rack 81 and the pinion 82, and therefore no rotation of shaft 76. With the clutch disengaged, the lifted member 75*c* remains fixed in height and the motor raises or lowers only the rack 81, thereby rotating the lift bar shaft 76.

Figure 7:
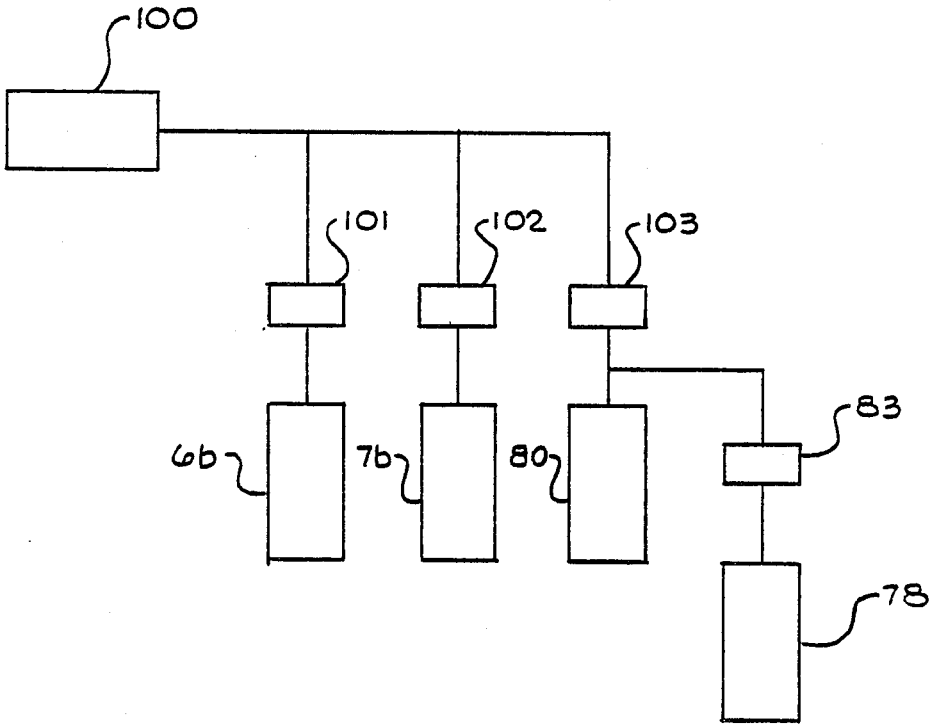
FIG. 7 is a partial schematic view showing a transfer arrangement using a single motor.

FIG. 7 shows schematically a transfer arrangement having a single motor. A motor 100 is coupled through clutches 101 and 102 to transport rollers 6*b* and 7*b*, respectively, and through clutch 103 to rotation screw 80 and, further, through clutch 83 to vertical drive screw 78. This arrangement saves the weight and cost of multiple motors.

Figure 8A:
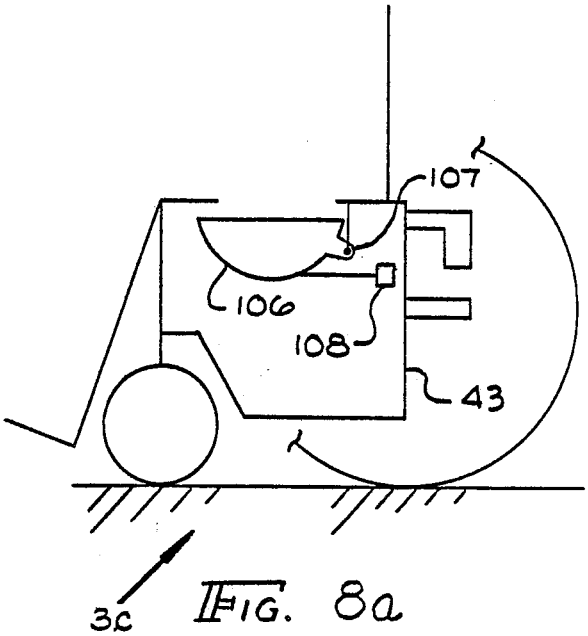
FIGS. 8*a* and 8*b* are side views showing schematically a pivoted chamber pot in a wheelchair.
Figure 8B:
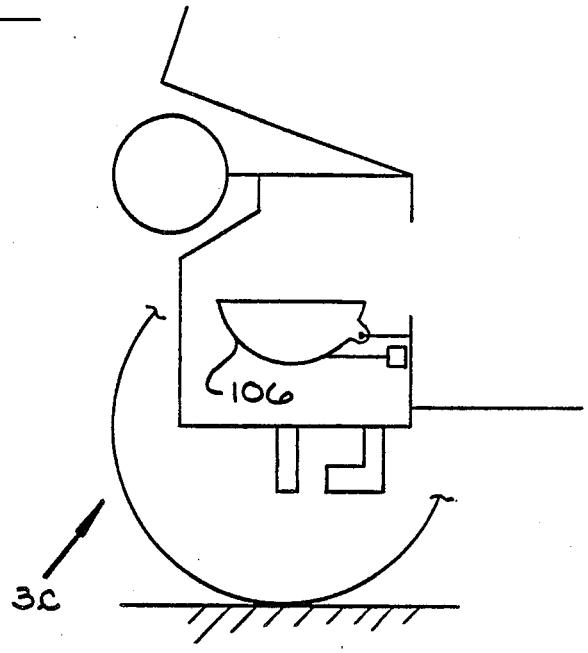

FIG. 8*a* shows schematically a commode wheelchair 3*c* having a chamber pot 106 removably and pivotally mounted to the frame 43 at pivot 107. With the attached weight 108, the chamber pot has its center of gravity substantially below the pivot 107. When the commode chair 3*c* is pivoted 90 degrees during a person transfer, as shown in FIG. 8*b*, the chamber pot 106 pivots as a pendulum, without tipping.

It is clear from FIGS. 4*a* through 4*g* that the portions of the wheelchair which require rotation and lifting to perform the transfer function include the seat 53, the lift bracket 55, the leg rest 54, and related portions of the frame 52. Only these portions of the wheelchair are rotated and lifted in an alternate embodiment of the present invention. In this alternate embodiment, the lower portion of the frame 52 with the wheels attached, is latched to a fixed bar below the lift bar 57. A separable upper portion of the frame 52 is attached to the seat and the leg rest and the lift bracket, which latches to the lift bar, for rotating and lifting, as described previously. In a commode chair, a chamber pot is mounted to and remains with the lower part of the frame 52.

Figure 9:
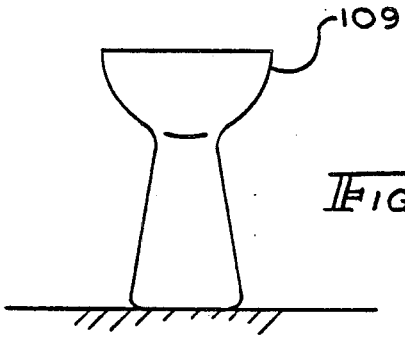
FIG. 9 is a schematic view showing a toilet.

FIG. 9 shows schematically a fixed toilet 109 which can be used, at the foot of the bed under a commode wheelchair.

Figure 10:
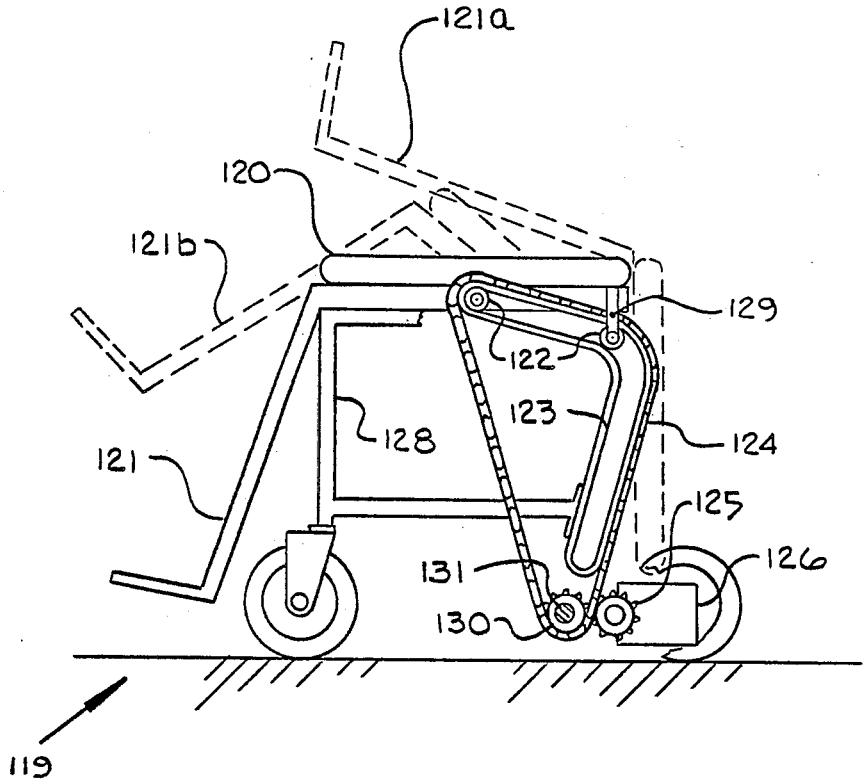
FIG. 10 is a partial schematic side view of a wheelchair showing an arrangement for rotating and lowering a seat and leg rest.

FIG. 10 is a partial side view of a wheelchair showing a different arrangement for rotating and lowering the seat and leg rest from the position shown in FIG. 4*c* to the position shown in 4*f*.

A seat 120 and attached leg rest 121 in a wheelchair 119 are supported in a seating position on a frame 128. Rollers 122, rotatably mounted on the seat 120 are rollably held in tracks 123 on each side of the wheelchair. For purposes of clarity, the track, frame, rollers and rear wheels on the near side of the wheelchair, are not shown. A chain 124 is attached to the seat at that point 129 and is slidably supported on the outside of the track 123 and by a sprocket 130, coupled through a shaft 131, shown in cross section, to a sprocket for driving an identical chain on the near side of the wheelchair. A sprocket 125 on a seat drive motor 126 engages the chain 124 for driving. Energizing the seat drive motor 126 drives the chain 124 thereby moving, rotating, and lowering the seat 120, with the rollers 122 moving in track 123. As shown in dashed lines, the leg rest 121 moves from its seating position through raised position 121*a* to 121*b*, which corresponds to the position in FIG. 4*f*. The seat drive motor 126 may be mounted on the frame of the wheelchair and connected to an electrical power source. Alternatively, the seat drive motor may be mounted on a bed, with the sprocket 125 being engaged with the chain 124 when the wheelchair is moved and locked to the bed.

Figure 11:
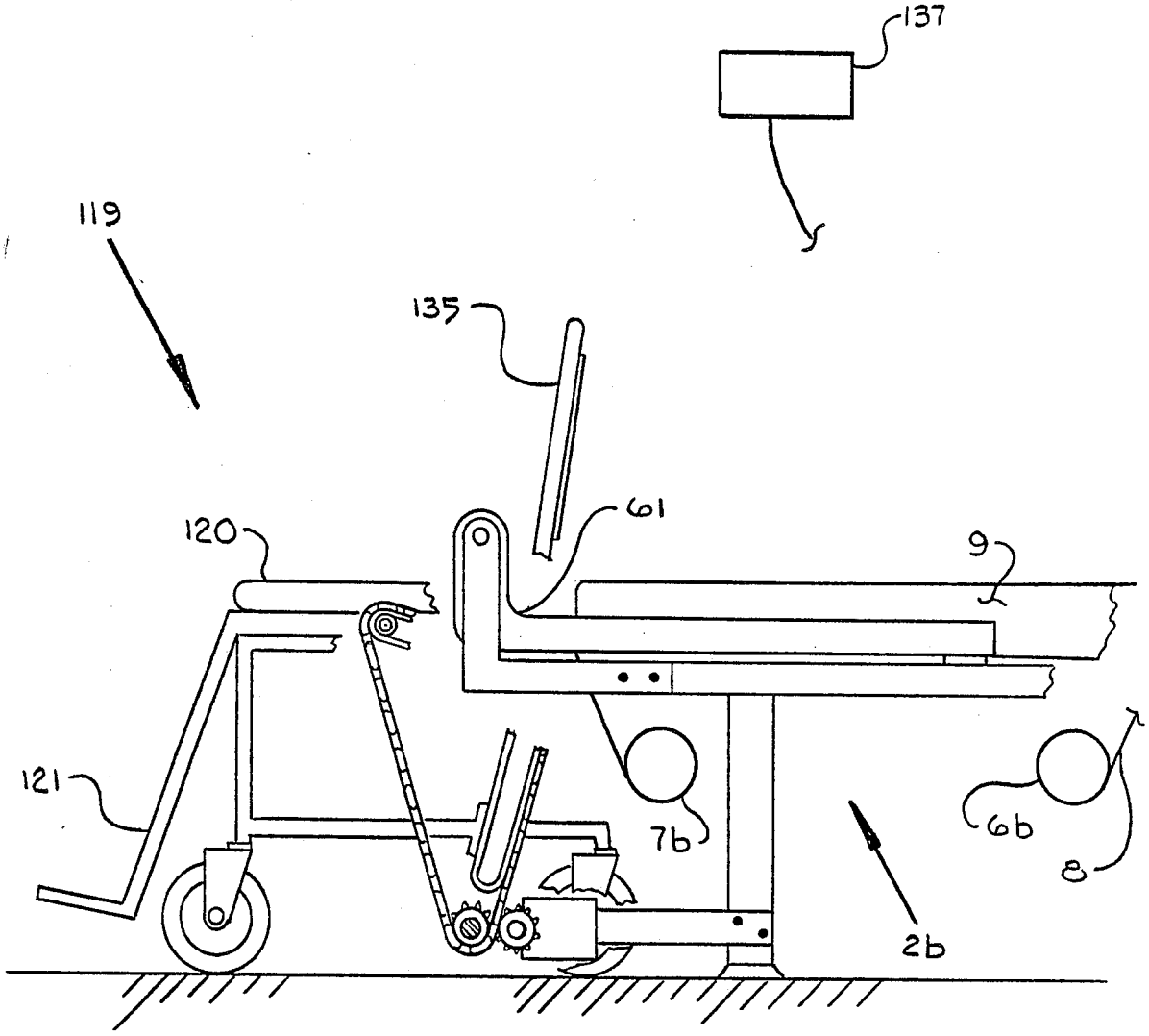
FIG. 11 is a schematic side view showing the wheelchair in FIG. 10 when latched to a bed for transferring a person.

FIG. 11 shows schematically the wheelchair 119 positioned at the foot end of the bed 2*b* for transferring a person between the wheelchair and the bed. The wheelchair has the arrangement shown in FIG. 10 for rotating and lowering the seat 120 and the leg rest 121. The wheelchair also has a removable back rest 135. The bed 2*b* has a transport sheet 8 over a mattress, and transport sheet drive rollers 6*b* and 7*b* which are coupled to sheet drive motors, not shown, and mattress lift arms 61 which are pivotally attached to the bed and are coupled to a lift arm drive motor, also not shown. By a control unit 137 connected to these several motors, the seat and leg rest, the mattress 9 and the transport sheet 8 are movable between the positions shown in FIGS. 4*a* and 4*g* for transferring a person between the wheelchair and the bed.

I claim:

1. A person transfer system comprising: a bed having head and foot ends and a mattress with a sheet thereon; a wheelchair positioned with its back at the foot of the bed; means for supporting the back and head of a person seated on the wheelchair; means for elevating and rotating the wheelchair's seat and leg rest and thereby rotating the person backwards onto the mattress; and means for moving the sheet across the mattress to transport the person between the wheelchair and the bed.

2. A person transfer arrangement comprising: a wheelchair removably positioned at an end of a bed; said wheelchair having a seat, a leg rest, a back rest, a frame, and wheels; said bed having a mattress and a transport sheet extending across said mattress; a head rest for supporting the head of a person sitting in said wheelchair; lifting means and rotating means for lifting and rotating together said seat, said leg rest, said back rest, said head rest and said person to place said head rest on said mattress and below said leg rest; said head rest being movable from behind said person's head; sheet motion means for moving said transport sheet in conjunction with lifting and rotating said seat for transporting said person between the wheelchair and the mattress; and control means for regulating movements of the transfer arrangement.

3. A person transfer arrangement as defined in claim 2 wherein said leg rest is movable to facilitate transfer of a person.

4. A person transfer arrangement as defined in claim 2 wherein said head rest is on said wheelchair; and means for moving said head rest behind said person's head.

5. A person transfer arrangement as defined in claim 2 wherein a part of said wheelchair is not rotatable by said rotating means; said part having a chamber pot removably attached thereto; said seat having an opening.

6. A person transfer arrangement as defined in claim 2, said transport sheet extending across said mattress and between rollers in vicinity of head and foot ends of the bed; said transport sheet being attached, and partially rolled up, on said rollers; a transfer module positioned at an end of said bed; said transfer module having a support with clamping means for grasping said wheelchair; rotating means for turning said wheelchair about a horizontal axis; lifting means for raising and lowering said wheelchair; said wheelchair being movable by said rotating means and said lifting means for transferring a person partially onto said mattress; sheet driving means on the bed for winding said transport sheet onto one of said rollers and off another said rollers for moving said transport sheet across the mattress; and control means for regulating said rotating means, said lift means, and said sheet driving means for transferring a person between said wheelchair and said bed.

7. A person transfer arrangement as defined in claim 2, including clamping means for grasping said wheelchair; said lifting means including a vertical drive motor attached to said bed and coupled to a vertical screw having a captured nut coupled to said clamping means.

8. A person transfer arrangement as defined in claim 2, including clamping means for grasping said wheelchair; said rotating means including motor and gears coupled for rotating said wheelchair substantially 90 degrees from a sitting position to a rotated position; and said wheelchair in its rotated position being lowerable to a bed-to-chair transfer position wherein said foot rest is movable on a slide to above said back rest and extending to the vicinity of an edge of said mattress.

9. A person transfer arrangement as defined in claim 2, including clamping means for grasping said wheelchair; said rotating means including a motor and gears coupled to said clamping means for rotating said wheelchair substantially 135 degrees from a sitting position to a rotated position; said wheelchair in its rotated position being lowerable to a bed-to-chair transfer position wherein said leg rest is in vicinity of an edge of said mattress; said leg rest being mounted on pivots in vicinity of said seat and being thereby pivotable to a substantially horizontal position level with said transport sheet.

10. A person transfer arrangement as defined in claim 2, including clamping means for grasping said wheelchair; said clamping means including a clamping motor coupled to clamp members; said clamp members being movable by said clamping motor to engage corresponding fixed members on said wheelchair to secure said wheelchair for lifting and rotating.

11. A person transfer arrangement as defined in claim 6, wherein said head rest is slidably mounted on said support; and a head rest motor coupled to said head rest for moving the head rest behind a person's head.

12. A person transfer arrangement as defined in claim 6, wherein said head rest comprises a head rest manually movable behind a person's head, said head rest being removably attachable to said support.

13. A person transfer system comprising a wheelchair at an end of a bed; said bed having a mattress and a transport sheet which is movable thereon; said wheelchair having a frame, a seat and a leg rest; means for supporting the back and head of a person seated on said wheelchair; means for raising and rotating the wheelchair backwards substantially 90 degrees so that said person's back is resting on the mattress; and means for moving said transport sheet on said mattress to transport the person between said wheelchair and said bed.

14. A person transfer arrangement as defined in claim 13 including means for raising said mattress behind said person's back and head; said back rest being removable from behind the person's back.

15. A person transfer arrangement as defined in claim 13 including means for raising and supporting said transport sheet behind said person's back and head to support said back and head; said back rest being removable from behind said person's back.

16. A person transfer arrangement as defined in claim 13 including means on said wheelchair for rotating and lowering said sheet and leg rest.

17. A person transfer arrangement as defined in claim 13, including means for raising said mattress behind said person's back and head to support the back and head; said back rest being removable from behind the person's back; said leg rest being attached to said seat; said seat being movably supported by rollers in tracks attached to said frame; said seat being movable downward from a horizontal sitting position to a substantially vertical position at said end of the bed and said leg rest being movable correspondingly from a sitting position extending down in front of the seat to an inclined transfer position extending upward from the end of the bed; a person's legs and feet being movable by motion of said person reclining on and carried by said transport sheet between said leg rest and said mattress; a drive motor coupled through a chain to said seat for moving said leg rest between said sitting position and said transport position.

18. A person transfer arrangement comprising: a wheelchair in vicinity of an end of a bed; said wheelchair having a seat, a leg rest, a removable back rest, and a frame with a lift bracket attached thereto; said bed having a mattress; a transport sheet extending across said mattress and between rollers in vicinity of head and foot ends of the bed; said transport sheet being attached and partially wound up on said rollers; a transfer module positioned at an end of said bed; said transfer module having a lift bar parallel to an edge of said mattress for engaging and holding said lift bracket; back support lift arms pivotally mounted on said transfer module; means for rotating said back support lift arms; rotating means for rotating said lift bar; lifting means for raising and lowering said lift bar; sheet driving means on the bed for winding said transport sheet onto one of said rollers and off another said rollers to move said transport sheet across the mattress and transport the reclining person between said wheelchair and said bed; and control means for regulating movements of said transfer arrangement.

19. A person transfer arrangement as defined in claim 18 wherein said back support lift arms are attached to a support under said mattress for lifting said mattress behind a person's back.

20. A person transfer arrangement as defined in claim 18 wherein said back support lift arms are attached to a support under said transport sheet for lifting and supporting said transport sheet behind a person's back.

21. A person transfer arrangement as defined in claim 18 wherein said back support lift arms engage thickened hems on said transport sheet for lifting and supporting said transport sheet behind a person's back.

22. A person transfer arrangement as defined in claim 18 wherein said back rest is removable by sliding below said seat.

23. A person transfer arrangement as defined in claim 18 wherein said lift bar extends along an edge of said bed; said wheelchair being attachable at multiple locations on said bar and along said edge.

24. A person transfer arrangement as defined in claim 18 wherein said lift bracket includes a latch for securing said lift bracket to said lift bar.

25. A person transfer arrangement as defined in claim 18 including: a driving member coupled to said rotating means; a driven member coupled to said back support lift arms; said driving member and said driven member being engaged for rotating said back support lift arms when said lift bar is fully raised, said driving member and said driven member being disengaged from rotating said back support lift arms when said lift bar is lowered.

26. A person transfer arrangement as defined in claim 18 wherein said rotating means has a first motor; said lifting means having a second motor.

27. A person transfer arrangement as defined in claim 18 wherein said rotating means and said lifting means include a clutch and only one motor.

28. A person transfer arrangement as defined in claim 18 wherein said back support lift arms are coupled to said lifting means through a clutch.

29. A person transfer arrangement as defined in claim 18 wherein said sheet driving means, said rotating means and said lifting means include only one motor coupled through four clutches.

30. A person transfer arrangement as defined in claim 18 wherein said seat has an opening; a chamber pot removably attached by a pivot to said frame; said chamber pot having a center of gravity substantially below said pivot so that the chamber pot remains stable against tipping when said wheelchair is rotated substantially 90 degrees.

31. A person transfer arrangement as defined in claim 18 wherein said seat has an opening; and a fixed toilet positioned near an end of said bed under said wheelchair.

32. A person transfer arrangement as defined in claim 18 wherein said control means includes a sensor with a roller; said sensor being movably supported by a spring; said transport sheet passing over and partially around said roller; tightening said transport sheet producing movement of said sensor against said spring; transducer means for measuring position of said sensor, and logic means for controlling said sheet driving means to regulate said position.

33. A person transfer arrangement as defined in claim 18 wherein said control means includes sensor means for measuring slack in said transport sheet, and logic means for controlling said sheet driving means for regulating said slack.

34. A person transfer arrangement as defined in claim 18 wherein said control means includes sensor means for measuring tension in said transport sheet; and logic means for controlling said sheet driving means to regulate said tension.

35. A person transfer arrangement as defined in claim 18 wherein said control means include a sensor for detecting a person's position and transmitting a sensor signal to logic circuitry; said logic circuitry controlling said lifting means, said sheet driving means, and said rotating means in accordance with said sensor signal to regulate said person's position for transferring said person between said bed and said wheelchair.

36. A person transfer arrangement as defined in claim 18 wherein said control means includes a switch on said leg rest; said switch being closable by a person's foot on said leg rest; said switch closure being conveyed to logic circuitry for controlling said sheet moving means, said lifting means, and said rotating means for transferring said person between said bed and said wheelchair.

37. A person transfer arrangement comprising: a wheelchair removably positioned with its back at an end of a bed; said wheelchair having a seat, a leg rest, a back rest, a frame, and wheels; said bed having a mattress and a transport sheet extending across said mattress; a head rest for supporting the head and shoulders of a person sitting in said wheelchair; a transfer module attached to the end of the bed; said transfer module having a support with clamping means for grasping said wheelchair; lifting means and rotating means for lifting and rotating substantially 90 degrees said support; said wheelchair and said person together, thereby placing said head rest on said mattress; said head rest being movable from behind said person's head; sheet motion means for moving said transport sheet in conjunction with lifting and rotating said seat for transporting said person between the wheelchair and the mattress; and control means for regulating movements of the transfer arrangement.

* * * * *